US009138987B2

(12) United States Patent
Houben et al.

(10) Patent No.: US 9,138,987 B2
(45) Date of Patent: Sep. 22, 2015

(54) CONTINUOUS JET PRINTING OF A FLUID MATERIAL

(71) Applicant: Nederlandse Organisatie voor toegepast-natuurwetenschappelijk onderzoek TNO, Delft (NL)

(72) Inventors: René Jos Houben, Delft (NL); Leonardus Antonius Maria Brouwers, Delft (NL); Andries Rijfers, Delft (NL); Robin Bernardus Johannes Koldeweij, Delft (NL)

(73) Assignee: NEDERLANDSE ORGANISATIE VOOR TOEGEPAST-NATUURWETEN SCHAPPELIJK ONDERZOEK TNO, Delft (NL)

( * ) Notice: Subject to any disclaimer, the term of this patent is extended or adjusted under 35 U.S.C. 154(b) by 0 days.

(21) Appl. No.: 14/374,519

(22) PCT Filed: Jan. 23, 2013

(86) PCT No.: PCT/NL2013/050033
§ 371 (c)(1),
(2) Date: Jul. 24, 2014

(87) PCT Pub. No.: WO2013/112046
PCT Pub. Date: Aug. 1, 2013

(65) Prior Publication Data

US 2014/0375726 A1 Dec. 25, 2014

(30) Foreign Application Priority Data

Jan. 26, 2012 (EP) ..... 12152602

(51) Int. Cl.

| | |
|---|---|
| ***B41J 2/03*** | (2006.01) |
| ***B41J 2/17*** | (2006.01) |
| ***B41J 2/14*** | (2006.01) |
| ***B41J 2/07*** | (2006.01) |

(52) U.S. Cl.
CPC .... *B41J 2/03* (2013.01); *B41J 2/07* (2013.01); *B41J 2/1433* (2013.01)

(58) Field of Classification Search
CPC ..... B41J 2/17; B41J 2/14; B41J 2/03
USPC ..... 347/47, 73–75, 87
See application file for complete search history.

(56) References Cited

U.S. PATENT DOCUMENTS

| | | | | |
|---|---|---|---|---|
| 6,364,457 | B1 | 4/2002 | Colecchi | |
| 7,364,285 | B2 * | 4/2008 | Murad et al. | 347/94 |
| 2006/0164469 | A1 | 7/2006 | Houben | |
| 2007/0064069 | A1 * | 3/2007 | Murad et al. | 347/84 |

FOREIGN PATENT DOCUMENTS

| | | | |
|---|---|---|---|
| CN | 101636273 | A | 1/2010 |
| CN | 101855089 | A | 10/2010 |
| EP | 1 923 215 | A2 | 5/2008 |
| WO | 2004018212 | A1 | 3/2004 |
| WO | 2007039078 | A1 | 4/2007 |

OTHER PUBLICATIONS

Hue P. Le, "Progress and Trends in Ink-jet Printing Technology," Recent Progress in Ink Jet Technlogies II, Chapter 1, General, 1999.
International Search Report dated Mar. 21, 2013, issued to PCT/NL2013/050033.
Office Action dated May 6, 2015 for CN Application No. 201380015203.1.

* cited by examiner

*Primary Examiner* — Sarah Al Hashimi
(74) *Attorney, Agent, or Firm* — Knobbe, Martens, Olson & Bear, LLP

(57) ABSTRACT

An apparatus and method are for printing a fluid material by a continuous jet printing technique. The apparatus includes a flow restricting structure arranged near an outflow opening for restricting a flow of the material between a reservoir and the outflow opening by a restricted passage through the flow restricting structure. Furthermore, the flow restricting structure, an actuating surface, and a nozzle are arranged to bind a micro volume directly adjacent an inside of the outflow opening for the purpose of guiding or reflecting pressure variations generated by the pressure regulating mechanism towards the outflow opening.

18 Claims, 17 Drawing Sheets

CONTINUOUS JET PRINTING OF A FLUID MATERIAL

This application is the U.S. National Phase of International Application No. PCT/NL2013/050033, filed Jan. 23, 2013, designating the U.S. and published in English as WO 2013/112046 on Aug. 1, 2013 which claims the benefit of European Patent Application No. 12152602.4 filed Jan. 26, 2012.

FIELD AND BACKGROUND OF THE INVENTION

The present invention relates to an apparatus for printing a fluid material by means of a continuous jet printing technique, comprising a reservoir for storing the material; an outflow surface comprising at least one outflow opening in fluid connection with the reservoir, from which outflow opening, in use, flows a jet of the material breaking up into drops; pressure generating means arranged for applying a pressure on the reservoir for passing the material under pressure from the reservoir in the direction of the outflow opening; a pressure regulating mechanism comprising an actuating surface arranged near the outflow opening for providing pressure variations of the material by means of vibration of the actuating surface for the purpose of obtaining a controlled breakup of the jet into drops.

In this connection, by "a continuous jet printing technique" is meant the continuous generation of drops which can be utilized selectively for the purpose of a predetermined printing process. The supply of drops takes place continuously, in contrast to the so-called drop-on-demand technique whereby drops are generated according to the predetermined printing process.

Document EP 1,545,884 B1 discloses a known apparatus for printing a fluid material by means of a continuous jet printing technique. To achieve a controlled breakup of the jet into drops, a sufficiently large pressure regulating mechanism is provided in front of the outflow opening. In the printing of fluids having a particularly high viscosity, work is done at an average relatively high pressure in the channel, e.g. in a range between 15 and 600 bar. To achieve a high regulating range for typical pressures the known apparatus of EP 1,545,884 B1 is provided with a pressure regulating mechanism comprising a movable control pin wherein an end of the control pin is placed at a predetermined distance in the distance interval of 15-500 μm from the outflow opening. Due to the distances in the distance interval being relatively small, a relatively large pressure regulating range can be realized. The known method of reducing the distance interval of the control pin to achieve satisfactory pressure variations at the outflow opening may have limits, e.g. because the control pin gets too close to the nozzle plate comprising the outflow opening and/or due to increasing stresses on the control pin and or other parts of the apparatus.

There is yet a need for continuous printing of materials with higher viscosities and/or at higher rates than currently possible.

SUMMARY OF THE INVENTION

In a first aspect there is provided an apparatus for printing a fluid material by means of a continuous jet printing technique, comprising a reservoir for storing the material; a nozzle comprising an outflow opening, from which outflow opening, in use, flows a jet of the material breaking up into drops; pressure generating means arranged for applying a pressure on the reservoir for passing the material under pressure from the reservoir in a direction of the outflow opening; a pressure regulating mechanism comprising an actuating surface arranged near the outflow opening for providing pressure variations of the material by means of vibration of the actuating surface for the purpose of obtaining a controlled breakup of the jet into drops; wherein the apparatus further comprises a flow restricting structure having an inlet, in use, in fluid connection with the reservoir, and an outlet, connected to a micro volume directly adjacent an inside of the nozzle, the flow restricting structure arranged for restricting a flow of the material between the reservoir and micro volume by means of a restricted passage through the flow restricting structure; wherein the restricted passage is dimensioned relative to the outflow opening such that, in use, a pressure drop of the material over the restricted passage between the inlet and outlet is between 0.1 and 10 times a pressure drop of the material over the outflow opening between the micro volume and an external surroundings of the nozzle; and wherein the flow restricting structure and the nozzle are arranged to bound the micro volume for the purpose of, guiding or reflecting pressure variations, generated by the pressure regulating mechanism, towards the outflow opening.

In a second aspect there is provided a nozzle piece for printing a fluid material by means of a continuous jet printing technique, comprising a nozzle comprising an outflow opening, from which outflow opening, in use, flows a jet of the material breaking up into drops; wherein the nozzle piece further comprises a flow restricting structure having an inlet, in use, in fluid connection with a reservoir, and an outlet, connected to a micro volume directly adjacent an inside of the nozzle, the flow restricting structure arranged for restricting a flow of the material between the reservoir and micro volume by means of a restricted passage through the flow restricting structure; wherein the restricted passage is dimensioned relative to the outflow opening such that, in use, a pressure drop of the material over the restricted passage between the inlet and outlet is between 0.1 and 10 times a pressure drop of the material over the outflow opening between the micro volume and an external surroundings of the nozzle; and wherein the flow restricting structure and the nozzle are arranged to bound the micro volume for the purpose of, guiding or reflecting pressure variations, generated by a pressure regulating mechanism comprising an actuating surface arranged near the nozzle, towards the outflow opening.

In a third aspect there is provided a method for printing a fluid material using a continuous jet printing technique, using an apparatus comprising: a reservoir for storing the material; a nozzle comprising an outflow opening in fluid connection with the reservoir; pressure generating means; a pressure regulating mechanism comprising an actuating surface arranged near the outflow opening; the method comprising using the pressure generating means for applying a pressure on the reservoir and passing the material under pressure from the reservoir in the direction of the outflow opening such that a jet of the material flows from the outflow opening breaking up into drops; using the pressure regulating mechanism for providing pressure variations of the material by means of vibration of the actuating surface for controlling the breakup of the jet into drops; wherein the method further comprises restricting a flow between the reservoir and the outflow opening by means of a restricted passage through a flow restricting structure comprising an inlet, in fluid connection with the reservoir, and an outlet, connected to a micro volume directly adjacent an inside of the nozzle; wherein the restricted passage is dimensioned relative to the outflow opening such that in use, a pressure drop of the material over the restricted passage between the inlet and outlet is between 0.1 and 10 times a pressure drop of the material over the outflow opening between the micro volume and an external surroundings of the nozzle; and guiding or reflecting pressure variations generated by the pressure regulating mechanism in the micro volume towards the outflow opening by means of the flow restricting structure and the nozzle.

The inventors discovered that by restricting flow of the fluid material between the reservoir and the outflow opening, pressure variations generated by the pressure regulating mechanism in a micro volume directly adjacent the outflow opening, can be guided or reflected towards the outflow opening instead of being propagated back to the reservoir. It was found that the amplitude of pressure waves reaching the outflow opening can be significantly enhanced without further increasing stress on the pressure regulating mechanism. Pressure waves from the actuating surface may thus efficiently propagate to the outflow opening and materials may be continuously printed with higher viscosities and/or at higher rates than previously possible.

BRIEF DESCRIPTION OF THE DRAWINGS

These and other features, aspects, and advantages of the apparatus, systems and methods of the present invention will become better understood from the following description, appended claims, and accompanying drawings. The drawings are not necessarily to scale unless indicated. Relative scales of objects, layers and components in the drawings may be exaggerated while some details may be omitted for illustrative purposes. In the drawings:

DETAILED DESCRIPTION

The following detailed description of certain exemplary embodiments is merely exemplary in nature and is in no way intended to limit the invention, its application, or uses. The description is therefore not to be taken in a limiting sense, and the scope of the present system is defined only by the appended claims. In the description, reference is made to the accompanying drawings which form a part hereof, and in which are shown by way of illustration specific embodiments in which the described devices and methods may be practiced. These embodiments are described in sufficient detail to enable those skilled in the art to practice the presently disclosed systems and methods, and it is to be understood that other embodiments may be utilized and that structural and logical changes may be made without departing from the spirit and scope of the present system. Moreover, for the purpose of clarity, detailed descriptions of well-known devices and methods are omitted so as not to obscure the description of the present system.

Globally, two inkjet procedures may be distinguished: drop on demand inkjet and continuous inkjet. With drop on demand inkjet, the energy for accelerating the material, pressing the material through the nozzle or outflow opening, and breaking the material up into drops has to be generated in full by the actuating mechanism. With continuous inkjet, these functions are typically separated over different elements: the pressure generating mechanism provides acceleration and pressing the material through the nozzle and the actuation mechanism also referred to as the pressure regulating mechanism substantially provides pressure variations that may cause the jet to break up into droplets in a controlled fashion. This latter concept is therefore typically better suited for further development in the processing of highly viscous materials, small drop sizes, and/or high flow rates. A challenge in the application of continuous jet printing of high viscous fluids may be to transfer sufficient vibrational energy to the emerging fluid jet. It is noted that the pressure generating mechanism may also operate based on flow control, wherein a pressure is generated such that a particular flow is realized.

Further advantages and applications may become more apparent from the following detailed description of the drawings. This description is to be regarded in an illustrative and non-limiting manner. In particular, steps and/or parts of the shown embodiments may be omitted and/or added without departing from the scope of the current methods and systems, which scope is defined by the appended claims.

Figure 1:
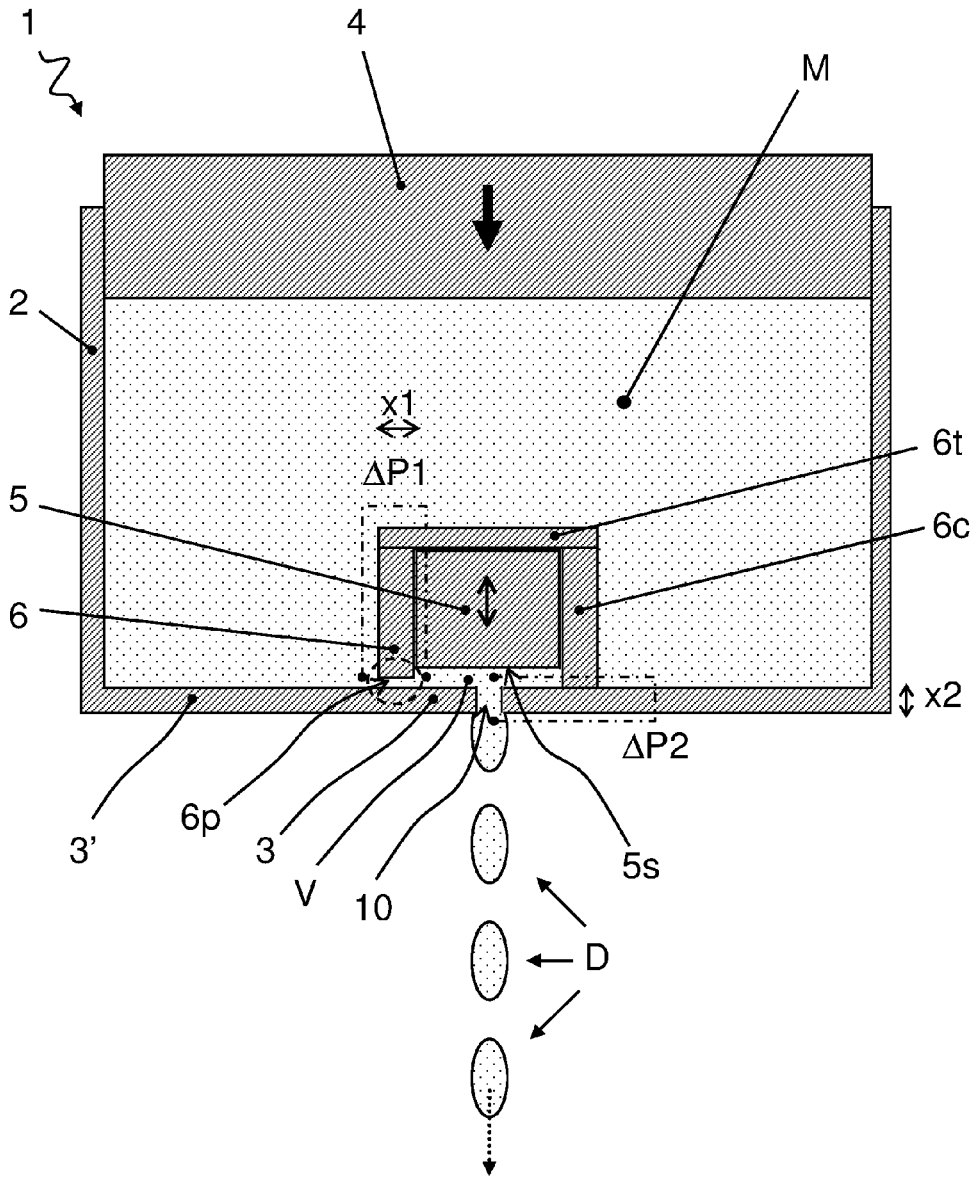
FIG. 1 shows a cross-section view of a first embodiment of a continuous jet printing apparatus.

FIG. 1 shows a cross-section view of an embodiment of an apparatus 1 for printing a fluid material M by means of a continuous jet printing technique. The apparatus 1 comprises a reservoir 2 for storing the material M and a nozzle 3 comprising an outflow opening 10. The term nozzle as used herein refers to the structure surrounding the outflow opening 10. In the shown embodiment the nozzle is provided in a nozzle plate 3'. The apparatus further comprises pressure generating means 4 and a pressure regulating mechanism 5. The pressure regulating mechanism 5 comprises an actuating surface 5*s* arranged near the outflow opening 10. The apparatus 1 further comprises a flow restricting structure 6 arranged for restricting a flow of the material M between the reservoir 2 and the outflow opening 10. The flow restricting structure 6, the actuating surface 5*s*, and the nozzle 3 are arranged to bound and at least partially enclose a volume V, hereinafter referenced as micro volume V, directly adjacent an inside of the outflow opening 10. With the term "micro volume" is meant a very small volume, e.g. in the range 0.001-100 micro liter (μl), preferably in the range 0.01-10 μl or smaller. The size of the micro volume may also be related to a drop size. In an embodiment the micro volume is between 10-10^5 times the volume of the drops to be created from the nozzle. In an example, wherein a drop size is 10^-4 μl, a corresponding micro volume may be 0.001-0.1 μl. A volume of the drops to be created may be related to a diameter of the nozzle, e.g. this volume may be on the order of a third power of the diameter D of the nozzle, e.g. between 0.1 and 10 times 4/3 π D^3. A further specification of the micro volume V is provided in the description of FIG. 3.

The outflow opening 10 is in fluid connection with the reservoir 2, i.e. the reservoir is connected to the outflow opening 10 such that, in use, fluid material M may flow from the reservoir 2 to the outflow opening 10. The pressure generating means 4 may be used for applying a pressure on the reservoir, i.e. on the material M in the reservoir, such that the material M is passed under pressure from the reservoir 2 in the direction of the outflow opening 10. While going from the reservoir 2 to the outflow opening 10, the material M is passed through a restricted passage 6*p* in the flow restricting structure 6. This restricted passage 6*p* causes a first pressure drop ΔP1 of the material between the reservoir 2 and the micro volume V in front of the outflow opening 10.

This first pressure drop ΔP1 takes place over a flow distance x1 that is related to a length along a flow direction of the restricted passage 6*p*. The resulting pressure gradient (dP/dx)1 in the restricted passage 6*p* may be calculated as the ratio of the pressure drop ΔP1 over the flow distance x1. When the material passes from the micro volume V through the outflow opening, the material experiences a second pressure drop ΔP2. This second pressure drop ΔP2 takes place over a flow distance x2, which is in this case determined by a thickness of the nozzle 3 or nozzle plate 3'. The resulting pressure gradient (dP/dx)2 in the outflow opening may be calculated as the ratio of the pressure drop ΔP2 over the outflow opening distance x2 or the thickness of the nozzle plate 3'.

In a preferred embodiment the actuating surface 5*s* is placed at a predetermined distance of 15-500 μm from the outflow opening 10. The pressure regulating mechanism 5 may cause, through vibration of its actuating surface 5*s* near the outflow opening 10, pressure variations in the fluid material that travel through the fluid in the micro volume V and out the outflow opening 10 into the emerging jet that flows from the outflow opening 10. By generating pressure variations or waves in the fluid material at appropriate frequency and amplitude, a controlled breakup of the jet into drops D may be effected, e.g. through a Rayleigh breakup process wherein pressure variations in the emerging jet cause the jet to break up at specific points resulting in a more mono disperse range of droplet sizes, e.g. wherein the droplet volume is in a range of 0.01 to 10 percent, preferably within 1 percent, of a mean droplet volume. The said frequency may be chosen e.g. close to a natural breakup frequency of the jet into drops. Alternatively, because the currently proposed method may provide an efficient transfer of the pressure variations, a frequency further away from the natural breakup frequency may be used. The said frequency may depend on a flow rate of the jet relative to a size of the outflow opening as well as characteristics of the liquid material. Typical frequencies for the current applications may be e.g. between 1 and 1000 kHz or higher. For larger drops this frequency may also be lower. The required pressure amplitude is related, e.g. proportional, to the base, i.e. average pressure at the outflow opening 10.

While using the apparatus for continuously printing the material, a jet of the material M may flow from the opening 10, breaking up into drops D. A dimension of the outflow opening 10, e.g. its diameter in particular for Rayleigh types of breakup typically corresponds to roughly half the cross-section diameter of the resulting drops D flowing from said outflow opening. This relation between diameter and drop size may typical of single piezo printers. Alternatively, when multiple piezos are focused, this relation may be different. Typical, but not limited dimensions for desired drop sizes in printing applications may in a range of e.g. 5-500 μm. The dimensions of the outflow opening may be in a typical range of 2-400 μm, but not limited to these dimensions A nozzle pressure across the outflow opening 10 may be related, e.g. linearly dependent, with flow rate and material M viscosity. It is to be appreciated that in order to push material M with a high viscosity (e.g. 500 mPa s or higher) and/or at high flow rates (e.g. more than 3 ml/minute) through a relatively small outflow opening, relatively high pressures may be required, in particular on an inside directly in front of the outflow opening. In the current embodiment, this pressure is to be provided by the pressure generating means 4 that is located upstream at the reservoir 2. However, since a flow restricting structure 6 is provided between the position at which the pressure is applied (in this case the reservoir 2) and the outflow opening 10 at which position the pressure may be required, this applied pressure is preferably raised to compensate for the pressure drop over the flow restricting structure 6

The deliberate insertion of a flow restricting structure 6 between the reservoir 2 and the outflow opening, such as currently proposed, may seem prima facie counterintuitive since this flow restriction 6 may cause a substantial pressure drop ΔP1 and therefore decreases the pressure available in front of the outflow opening compared to the pressure applied at the reservoir 2. This may seem especially counterintuitive since the desire to print higher viscosity materials, at higher rates and/or through smaller nozzles may call for higher pressure requirements. It is noted that a pressure drop over an opening may be proportional to the fourth power of a diameter of that opening.

However, it is currently recognized that the desire for continuous printing of high viscosity fluid materials may be limited not only by the available pressure that can be delivered by the pressure generating means but also by the increasing demands that are put on the pressure regulating mechanism 5 at high working pressures, e.g. the forces that it can deliver or withstand.

As was noted above, the pressure variations are preferably of a sufficient pressure amplitude, i.e. cover a sufficient range of pressure variation to cause the controlled breakup of the jet into drops. The pressure variations that are to be delivered by the pressure regulating mechanism 5 may be regarded as a modulation on top of the average pressure that may be ultimately traced to the pressure generating means 4. Since the mean or base pressure level of the viscous material in front of the outflow opening 10 is preferably high in order to force the material at sufficient flow rates through the small outflow opening 10, similarly the desired pressure variations for a controlled breakup of the jet are preferably correspondingly high, e.g. 1% or more of the base pressure in front of the opening, e.g. 5 bar to 10 bar or higher. Accordingly, in an embodiment, the pressure regulating mechanism 5 is preferably arranged for generating a pressure variation upstream of the outflow opening 10 of at least one percent 1 bar of a pressure of the material in the micro volume.

In order to deliver such relatively high pressure variations at the outflow opening, a first solution may be to place the actuating surface 5*s* sufficiently close to the outflow opening, e.g. in the distance interval of 15-500 μm from the outflow opening, such that the pressure waves are less dampened or dissipated before they reach the outflow opening. However, this solution may not suffice for particularly high viscosities and/or high flow rates, e.g. because at some point the actuating surface 5*s* comes to close to the nozzle 3 and may possibly block the outflow opening.

It is currently recognized that a large part of the damping or dissipating of the pressure variations may be prevented by restricting the said pressure variations to a small micro volume V in front of the outflow opening. By introducing a flow restricting structure 6 and providing only a restricted passage 6*p* back to the reservoir 2, pressure variations created in the micro volume V are largely prevented from traveling back to the reservoir 2 and instead may be guided or reflected towards the outflow opening 10, e.g. by the surfaces surrounding the micro volume. The micro volume V is bounded by the flow restricting structure 6 together with the actuating surface 5*s* and the inner surface of the nozzle 3, while substantially the only fluid passages into an out of the micro volume V are provided by the restricted flow passage 6*p* and the outflow opening 10.

In order to guide or reflect pressure variations towards the outflow opening 10 and largely prevent them from dissipating back to the reservoir, the restricted passage 6*p* preferably has a flow resistance and/or resistance to guiding the pressure variations that is comparably to or larger than that of the outflow opening. In this way the preferable flow path for the pressure variations will be the outflow opening 10 and not the restricted passage 6*p*. This may be compared e.g. to an electric current flowing parallel through two resistors, wherein the most current flows through the lowest resistance. When the flow resistance of the backflow path through the restricted passage 6*p* becomes comparable to or higher than the resistance of the outflow path through the outflow opening 10, the flow of the pressure variations may be directed more towards the outflow opening thus resulting in an overall increased efficiency of the pressure regulating mechanism 5.

The flow resistance Rf over a passage may be defined e.g. as the ratio of the pressure ΔP over the passage divided by the flow f through the passage such that $\Delta P = f \cdot Rf$. When it is desired that a pressure drop over the restricted passage and the outflow opening are of the same order, in a closed system where the flows through the restricted passage and the outflow opening are the same, it may follow that it is preferable to have a flow resistance through the flow restriction that is on the same order than a flow resistance through the outflow opening. When the total flow is different, e.g. when multiple outflow openings are connected to a single flow restriction, the desired ratio of flow resistances may scale accordingly. E.g. when a plurality of outflow openings are connected to a single micro volume, because the flow is split over multiple outflow openings, to keep the resulting pressure drop of the same order over the outflow openings and over the restricted passage, e.g. the flow resistance of the flow restriction may be scaled down by the number of outflow openings.

It is noted that the instantaneous flow resistance, or impedance, felt by the pressure waves as they travel from the micro volume, either through the outflow opening or the restricted passage, may be related not only to the total flow resistance but also the gradient of the flow resistance over the flow path. In analogy to an electric circuit, preferably the input impedance of the flow restriction 6*p* is comparable to or greater than the input impedance of the outflow opening. In this way pressure waves generated in the micro volume V travel only minimally up the restricted passage. It is noted that the flow resistance may also be a complex function of the frequency of the pressure variations, e.g. in analogy with a complex impedance of an electric circuit. It may be desired that a flow path from the pressure regulating mechanism back through the flow restriction to the reservoir has a flow impedance at a frequency of the pressure variations, generated by the pressure regulating mechanism that of the same order or larger than a flow impedance of a flow path from the pressure regulating mechanism through the outflow opening at that frequency.

The relative flow resistance gradient may be characterized e.g. by comparing the first pressure gradient (dP/dx)1 of the first pressure drop ΔP1 of the material M over the restricted passage 6*p* to the second pressure gradient (dP/dx)2 of the second pressure drop ΔP2 of the material M over the outflow opening 10. To sufficiently prevent the pressure variations generated by the pressure regulating mechanism 5 to flow back to the reservoir 2, the said pressure gradients are preferably on the same order, e.g. the ratio between the pressure gradient (dP/dx)1 and (dP/dx)2 is preferably between 0.1 and 10. The pressure gradient may be calculated e.g. by taking the pressure drop ΔP1 or ΔP2 over the flow restricting structure 6*p* or outflow opening 10 and dividing this pressure drop by a respective flow length x1 or x2.

Alternatively or in addition, for comparable cross-sections between the flow restricting structure and the outflow opening, preferably, a length x1 of the restricted flow path 6*p* along a flow direction is comparable to a length x2 of the outflow opening 10 along a flow path through the nozzle 3. In particular it is preferred that the lengths x1 and x2 are chosen such that the total (average) pressure drops ΔP1 and ΔP2 are comparable, e.g. having a ratio between 0.1 and 10.

When the flow restriction has a different cross-section than the outflow opening, the lengths x1 and x2 may be scaled according to the caused pressure drop. This pressure drop may depend on the fluid dynamics involved and calculated accordingly. For circular openings the pressure drop may e.g. scale inversely proportional to the fourth power of the diameter of that opening. E.g. for a flow restriction with diameter D1 and length x1 and an outflow opening with diameter D2 and length x2, these parameters are preferably such that $x1/D1^4$ is comparable to $x2/D2^4$, e.g. their ratio $(x1/D1^4)/(x2/D^4)$ is between 0.1 and 10.

It is noted that since the pressure in the micro volume V may vary due to the actuation by the pressure regulating mechanism 5, so the pressure drops ΔP1 and ΔP2 as well as the pressure gradients (dP/dx)1 and (dP/dx)2 may vary somewhat. For the purpose of determining a certain ratio, e.g. the average pressure drops or gradients may be considered. Alternatively, the pressure drops or gradients may be considered when the pressure regulating mechanism is turned off, i.e. not actuating the micro volume. The pressures and pressure gradients may e.g. be calculated based on numerical or model simulations of the various components described and the pressure and pressure variations applied.

It is further noted that the pressure drop ΔP1, which lowers the pressure available in front of the outflow opening 10 delivered by the pressure generation 4, may be compensated by increasing the pressure applied by the pressure generating means 4 before the flow restriction 6*p* while still benefitting from the increased efficiency of the pressure wave transfer from the pressure regulating means 5 to the outflow opening. However, the first pressure drop ΔP1 relative to the second pressure drop ΔP2 is preferably such that the pressure generating means 4 may still provide the appropriate pressure in front of the outflow opening while compensating for the pressure drop ΔP1. This may put an upper limit on a preferable first pressure drop ΔP1, e.g. preferably no more than ten times the second pressure drop ΔP2, or for lower viscosity materials no more than twice the second pressure drop ΔP2.

Another characterization of the desired relative flow resistance may be to compare the relative dimensions of the restricted passage 6*p* and the outflow opening 10. To sufficiently prevent the pressure variations generated by the pressure regulating mechanism 5 to flow back to the reservoir 2, e.g. it may be preferable that an effective cross-section of the restricted passage leading to the micro volume V be on the same order as, e.g. between 0.1-10 times a cross-section of the outflow opening 10. With effective cross-section is meant the cross-section perpendicular to the flow direction of the material. It is noted that a lower limit of the cross-section of the restricted passage is preferably such that the pressure generating means 4 may still provide sufficient pressure at the outflow opening.

For example in order to push material with a viscosity of 500 mPa s through an 80 μm diameter, 88 μm length outflow opening at a flow rate of 3 ml/minute, an average static pressure of about 70 bar (=7 MPa) may be required in front of the outflow opening. In that case a static pressure applied by the pressure generating means 4 at the reservoir 2, may be e.g. twice as much: 140 bar. The flow restriction is dimensioned relative to the outflow opening such that the mean static pressure in the micro volume V is 70 bar, while the pressure varying mechanism causes a pressure variation amplitude of e.g. 10 bar, i.e. the pressure in the micro volume varies between 65 and 75 bar. A frequency of a vibration of the pressure varying mechanism is e.g. 20 kHz. The pressure outside the outflow opening may e.g. be an ambient pressure of 1 bar. In this case the first pressure drop ΔP1 is 70 bar while the second pressure drop ΔP2 is 69 bar (70−1). The pressure drops ΔP1 and ΔP2 are on the same order while their ratio is close to 1.

It is noted that while in the current embodiment of the apparatus 1, a pressure generating means 4 is shown as a block exerting mechanical pressure on the material M, various other pressure generating means may be known to the skilled artisan. For example, the pressure generating means may comprise alternatively or in addition a pressurized gas supply connected to the reservoir, wherein a pressure of the gas is relayed to the material M in the reservoir.

It is further noted that while in the current embodiment, the reservoir 2 forms a single structure with the nozzle plate 3', alternatively, these structures may be separate, e.g. the reservoir 2 may be connected to the restricted passage 6*p* by fluid transport guides such as tubes or hoses.

Furthermore, while in the current embodiment, a single outflow opening 10 and nozzle is shown in a nozzle plate 3, this may of course be expanded to a plurality of nozzles. Each of the plurality of nozzles openings may be adjacent to a separate micro volume and be provided with its own pressure regulating mechanism and fed from the reservoir via a separate restricted passage. Alternatively, multiple outflow openings may be present in a single micro volume and share a pressure regulating mechanism. Also a single pressure regulating mechanism may be connected to a plurality of actuating surfaces that may be distributed over a plurality of micro volumes. Also multiple restricted passages may be provided e.g. from multiple sides to a single micro volume, wherein the passages may be seen as parallel paths that constitute a certain effective flow resistance, pressure drop, and total cross-section.

Also while in the current embodiment the nozzle 3 is shaped like a plate, this may also be shaped differently, e.g. converging like a pipette. The nozzle 3 may comprise any suitable material that can withstand the pressure in the micro volume V. It is to be appreciated that the total force exerted by a high pressure material in a small chamber may be relatively low due to the small surface area over which this pressure is exerted.

The pressure regulating mechanism 5 as shown may e.g. comprise a piezo element for creating the vibrations. Other mechanisms for creating pressure variations may include e.g. small electromagnetic actuators, electrorestrictive actuators, creating acoustic pressure vibrations.

It may be clear from the foregoing that these and other variations and combinations of parts and concepts may be employed by the skilled artisan without departing from the scope of the present invention.

Figure 2:
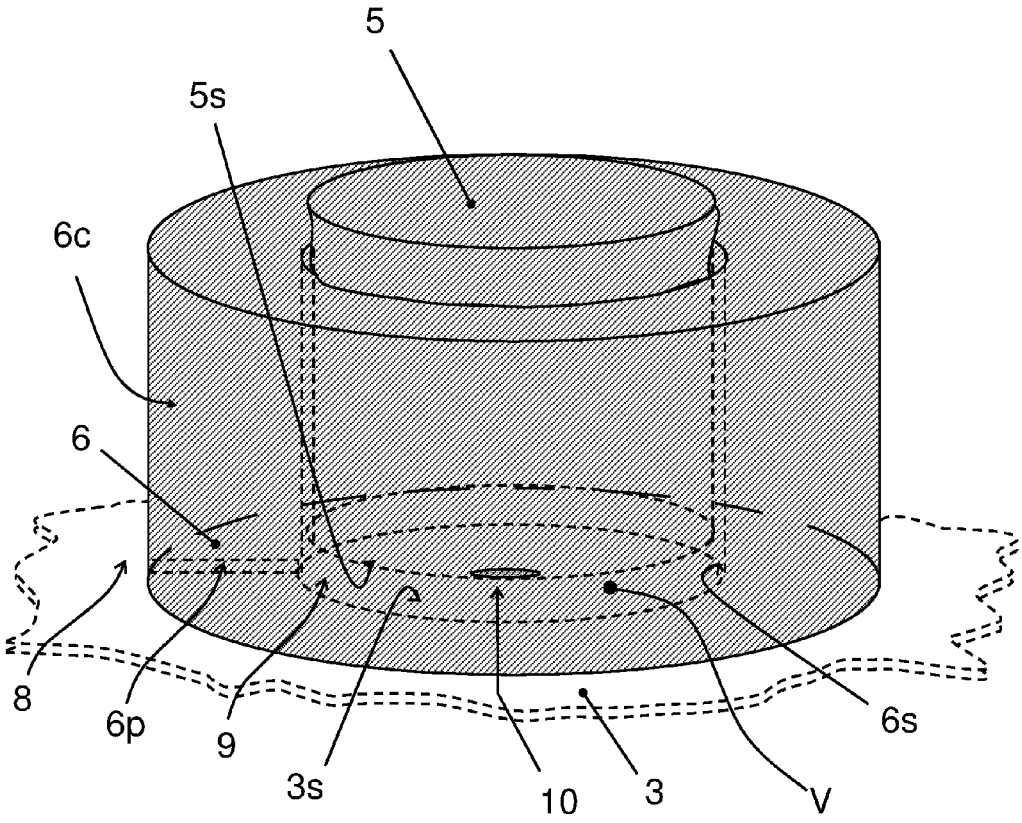
FIG. 2 shows a perspective view of a pressure regulating mechanism.

FIG. 2 shows a close-up perspective view of an embodiment of the pressure regulating mechanism 5 comprising a control pin, e.g. a small closed cylinder. An end of the control pin forms an actuating surface 5*s* opposite the surface 3*s* of the nozzle 3. The control pin is arranged to vibrate towards and away from the outflow opening, while being guided at least partially inside a pin guide 6*c*, e.g. an open cylinder surrounding the control pin the cylinder e.g. closed on top by a plate 6*t*. The pin guide 6*c* additionally bounds the micro volume V by its inner surface 6*s*. The micro volume V is further bounded by the actuating surface 5*s* and the surface 3*s* of the nozzle 3. The pin guide 6*c* forms a flow restricting structure 6 through which a restricted passage 6*p* is provided that connects the micro volume V to the reservoir (not shown here).

In use, fluid material may flow under pressure generated by the pressure generating means (not shown) from an exit point 8 of the reservoir (or fluid guiding means connected to the reservoir) through the restricted passage 6*p* to an entry point 9 of the micro volume V. Fluid material is forced under pressure through the outflow opening 10 while the said pressure of the fluid material in the micro volume V is modulated by a vibration of the pressure regulating mechanism 5 and its surface 5*s* that is in mechanical contact with the fluid material in the micro volume V.

Figure 3:
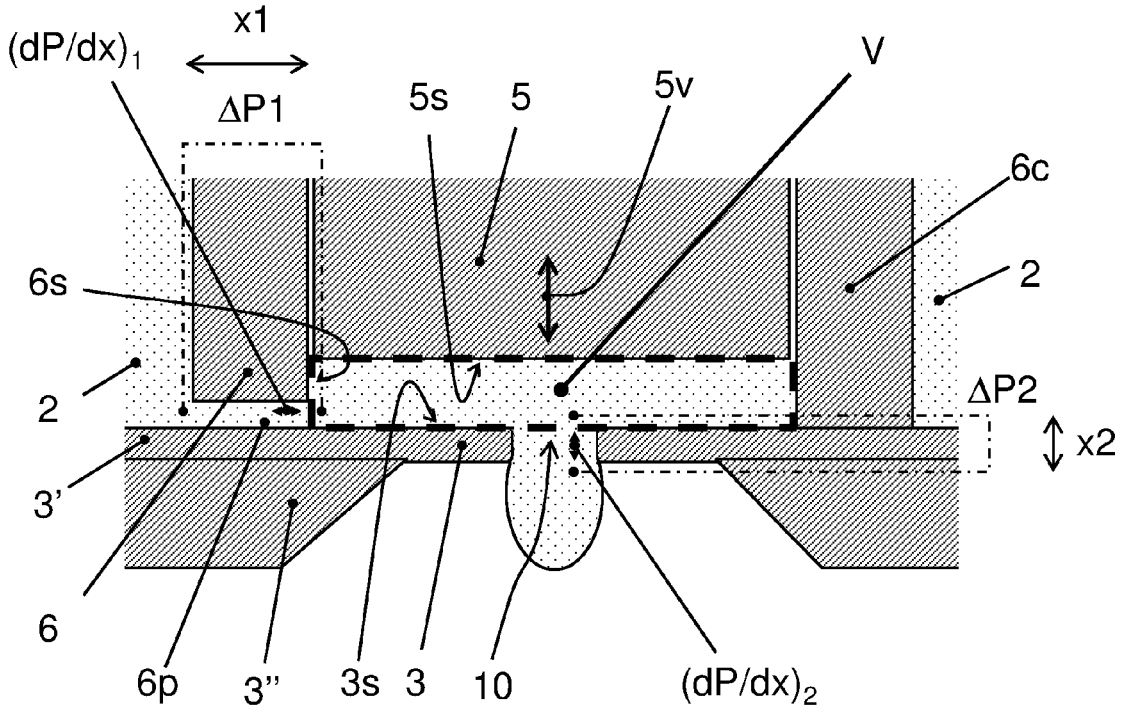
FIG. 3 shows a cross-section view of a detail of a first embodiment of an outflow opening.

FIG. 3 shows a close-up cross-section view of an embodiment of the apparatus wherein the micro volume V is further illustrated. As shown by the dashed line, the micro volume V is bounded by an inner surface 3*s* of the nozzle 3, by the actuating surface 5*s* of the pressure regulating means 5 and an inner surface 6*s* of the flow restricting structure 6. The micro volume may of course be further bounded by other surface, e.g. that of the pin guide 6*c* which in this case may be regarded as part of the flow restricting structure, i.e. a structure that restricts the flow of fluid material between the reservoir 2 and the micro volume V.

The micro volume V may be defined e.g. as the amount of fluid material M occupying the space between the end of the restricted passage 6*p* and the beginning of outflow opening 10. The end of the restricted passage 6*p* and the beginning of outflow opening 10 may be defined e.g. by extending the inner surfaces of the flow restricting structure 6 and/or the nozzle 3 as is shown by the dashed line in this figure. To calculate the micro volume V for the shown embodiment, e.g. the surface area of the actuating surface 5*s* may be multiplied by an average distance between the actuating surface 5*s* and the surface 3*s* of the nozzle. It is noted that this distance may vary by a vibration amplitude of the actuating surface 5*s*. As an example, e.g. the micro volume may be a cylinder shaped volume with a diameter of 3300 μm and an average height of 50 μm (varying e.g. by a vibrating amplitude of the actuating surface of e.g. 15 nm). The micro volume V in this case is approximately 0.4 μl (=π/4·(3300 μm)^2·50 μm). It is noted that for a multi-nozzle configuration, the micro volume may be proportionally higher with the number of nozzles.

The above specified preferred range of the micro volume between 0.001 and 100 μl, preferably between 0.01 and 10 μl, and/or between 10-10^5 times the volume of a typically generated single drop of the specified system, may determine a preferred position of the flow restricting structure 6 and actuating surface 5*s*. Preferably, the flow restricting structure 6, or at least the inner surface 6*s* where the flow restricting structure 6 touches the micro volume V, and the actuating surface 5*s* are near the outflow opening 10 (and thus also the nozzle surface 3*s*) such that the micro volume V has a volume in the above specified range. Thus together the surfaces 6*s*, 5*s*, and 3*s* bound the micro volume V.

In use, material may flow under pressure from the reservoir 2 to the micro volume V via the restricted passage 6*p*, whereby the material experiences a first pressure drop ΔP1. The flow of material is in this case is restricted to the passage 6*p* having a cross-section relative to the cross section of the outflow opening such that pressure waves in the micro volume, generated by a vibrating motion 5*v* of the pressure regulating means 5, are substantially prevented from traveling back to the reservoir via the passage 6*p*, but instead guided and reflected towards to outflow opening 10.

The cross-section of the restricted passage (cross-section perpendicular to the flow direction) may determine a first pressure gradient (dP/dx)1 of the material M in a flow direction along the restricted passage 6*p*. Similarly the cross-section of the outflow opening 10 may determine a second pressure gradient (dP/dx)2 of the material M in a flow direction along the outflow opening 10. In an embodiment a ratio between the first pressure drops gradient (dP/dx)1 along a flow path between the reservoir 2 and the micro volume V and a second pressure gradient (dP/dx)2 along a flow path between the micro volume V and the external surrounding, i.e. at the outside of the outflow opening 10, are comparable in magnitude. E.g., preferably this ratio is somewhere in a range of 0.1-10 which on the one hand may cause sufficient reflection of pressure variations from the restricted passage 6*p* and on the other hand not restrict the flow too much for the pressure generating means to compensate.

In the shown embodiment, the nozzle 3 is comprised in a thin nozzle plate 3' that is additionally supported by a support plate 3". This configuration has an advantage that a length of the outflow passage may be kept short, e.g. determined by the thickness of the nozzle plate 3' while still retaining sufficient support to withstand the pressure in the micro volume V. A thickness of the nozzle plate may e.g. be in a range from 50 micrometer to 400 micrometer. Alternatively, a thickness of the nozzle plate or a length of the nozzle may be related to the cross-section of the nozzle, e.g. the thickness of the nozzle plate 3' may be between 0.1 and 10 times a cross-section of the outflow opening 10 in the nozzle 3. It is noted that e.g. for a nozzle having a varying cross-section, an effective diameter may be defined as the diameter of an equivalent nozzle with constant diameter causing the same pressure drop.

The term "nozzle plate" may be interpreted broadly. The nozzle plate may be composed of a plurality of parts. Said parts may be mutually attached, thus forming a structure provided with one or more nozzles 3. Said nozzle plate 3' may be substantially made of steel. For example, a method for producing the desired nozzle shape may involve the use electro discharge machining. An advantage of this method is that a nozzle shape may be precisely determined. Other materials besides (stainless) steel may be copper, titanium, and molybdenum. An alternative method may employ etching techniques, e.g. in silicon. Alternatively still, laser light may be used to cut the nozzles either in metal or in a ceramic material, e.g. through laser ablation. Advantages of ceramic materials may be a longer lifetime and/or durability of the nozzles compared to metal. Other materials include sapphire, diamond, or ruby. The nozzles may also be coated, e.g. by nitrides, to increase durability.

When the outflow passage 10 is shorter, the second pressure drop ΔP2 can be lower and/or the outflow opening cross-section can be lower, which may result in smaller droplets. It is thus noted that the pressure drops ΔP1 and ΔP2 are determined not only by the cross-section of the passage 6*p* and outflow opening 10, respectively, but also by their length. E.g. a similar pressure drop may be obtained by lowering both the cross-section and the length of the passage or opening, by scaling the length with the diameter to the fourth power and/or the square of the cross-section.

Figure 4A:
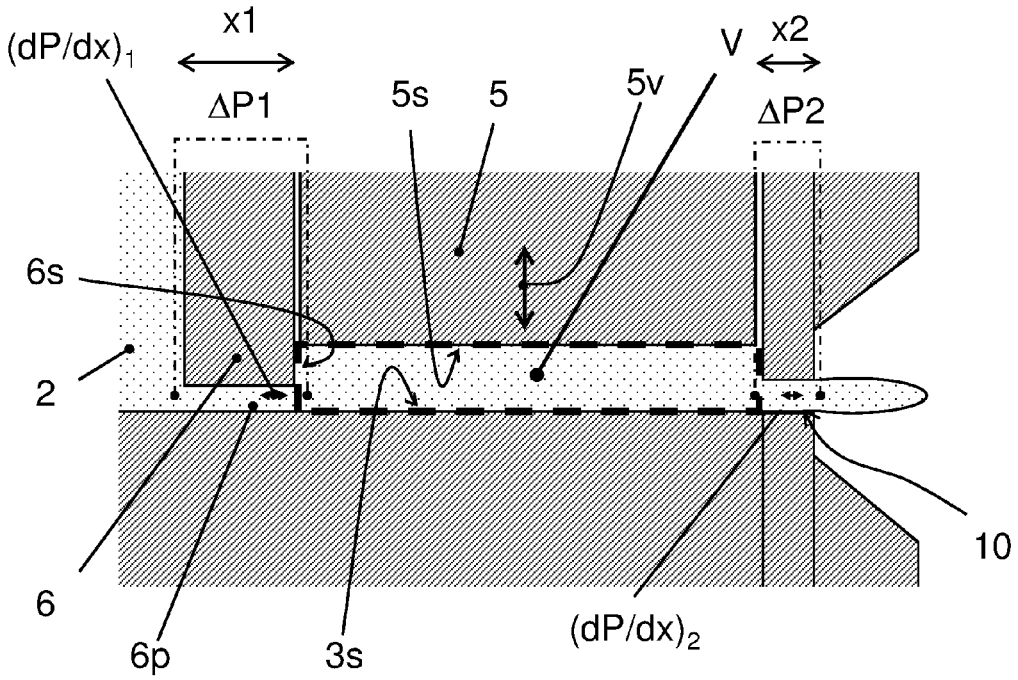
FIG. 4A shows a cross-section view of a detail of a second embodiment of an outflow opening.

FIG. 4A shows a cross-section view of a detail of a second embodiment of an outflow opening. The embodiment is similar to that of FIG. 3, except that the pressure regulating mechanism 5 generates pressure variations in a direction perpendicular to the direction of the outflow through the outflow opening 10. The references numbers, symbols, and letters in this figure point to similar or like items as in FIG. 3. While the jet flowing out of the outflow opening is shown as flowing to the right, it is to be understood that the orientation of the apparatus as shown may be rotated, e.g. such that the jet out of the outflow opening flows in a downward direction, while the pressure regulating mechanism may still vibrate in a direction perpendicular to the direction of outflow.

In use, material M flows from the reservoir 2 through the restricted passage 6*p* in the flow restricting structure 6 into the micro volume V. The material thereby experiences a first pressure drop ΔP1. The pressure regulating mechanism 5 generates pressure variations in the material M in the micro volume V. This material flows as a jet out of the outflow opening 10 while breaking up into drops. Preferably, pressure variations, generated in the micro volume are directed in a direction of the outflow opening and dissipated as little as possible into the reservoir 2. To this end the flow restriction 6 preferably substantially prevents at least some of the pressure variations to travel back to the reservoir 2.

Such a condition may be achieved e.g. when the restricted passage 6*p* is dimensioned relative to the outflow opening 10 such that, in use, a pressure drop ΔP1 of the material M over the restricted passage 6*p* is between 0.1 and 10 times a pressure drop ΔP2 of the material M over the outflow opening 10. Furthermore, preferably, the flow restricting structure 6, the actuating surface 5*s*, and the nozzle 3 are arranged to bound a micro volume V directly adjacent an inside of the outflow opening 10 for the purpose of guiding or reflecting the pressure variations generated by the pressure regulating mechanism 5 towards the outflow opening 10.

Figure 4B:
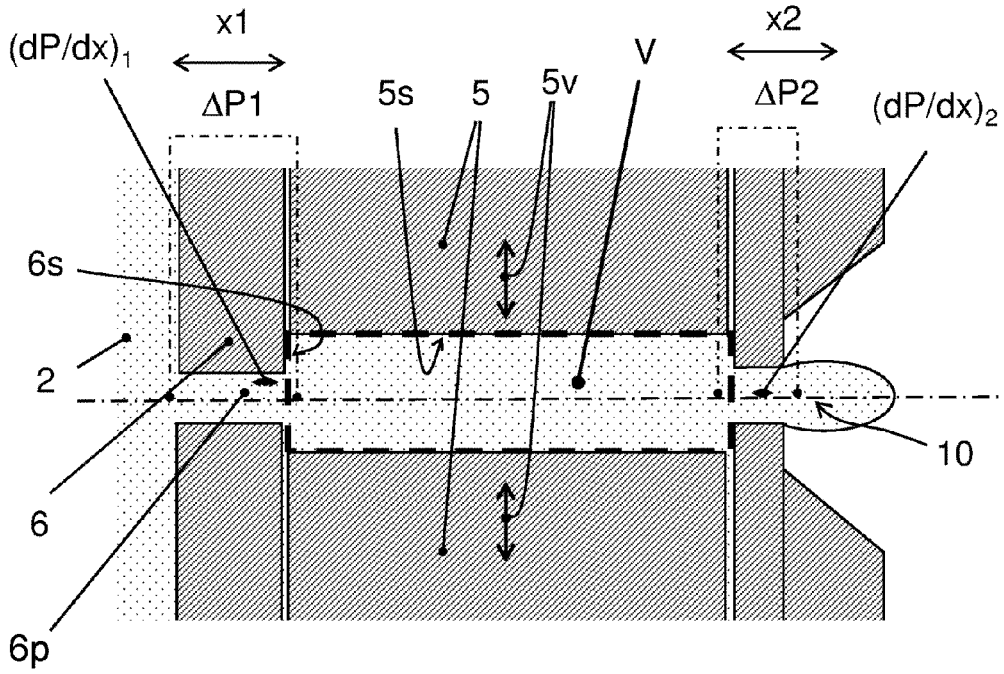
FIG. 4B shows a cross-section view of a detail of a third embodiment of an outflow opening.

FIG. 4B shows a cross-section view of a detail of a third embodiment of an outflow opening. The embodiment is similar to that of FIG. 4A, except that the pressure regulating mechanism 5 is provided on at least two sides of the micro volume. The references numbers, symbols and letters in this figure point to similar or like items as in FIG. 3.

In an embodiment the pressure regulating mechanism 5 comprises a vibrating ring surrounding the micro volume V wherein an inside of the ring forms the actuating surface 5*s*. Such a vibrating ring may be formed e.g. by a ring piezo. The restricted passage 6*p* is arranged on an opposite side of the ring from the outflow opening 10. In use, the pressurized fluid material M flows from the reservoir via the fluid passage 2*p* and the restricted passage 6*p* into the micro volume V. The material then flows through the vibrating ring, thereby being actuated by the actuating surface 5*s* before emerging from the outflow opening 10 as a jet breaking up into drops D. When emerging from the outflow opening, e.g. to the external surroundings, the material experiences a second pressure drop ΔP2.

As is shown in the figure, a surface of the flow restricting structure 6, the actuating surface 5*s*, and a surface of the nozzle 3 are arranged to bound a micro volume V directly adjacent an inside of the outflow opening 10. This has a purpose of guiding or reflecting the pressure variations generated by the pressure regulating mechanism 5 towards the outflow opening 10. Thereby an efficiency of the pressure regulating mechanism 5 may be increased, e.g. the pressure regulating mechanism 5 requires less energy and/or lower forces may be experienced by the pressure regulating mechanism 5 while still providing sufficient control over the breakup of the jet into drops D. It is noted that the chamber enclosing the micro volume may comprise additional walls or surfaces besides those mentioned above.

While the micro volume V in the current embodiment may be a round cylinder shaped chamber leading to the outflow opening 10, other shapes may be possible. For example, the outflow surface 3 may comprise an elongated and narrowing nozzle, e.g. shaped like a pipette. Accordingly in an embodiment the nozzle 3 comprises a converging pipette shape in a flow direction of the material. Such a pipette shaped nozzle may provide additional advantages in guiding the pressure waves towards the outflow opening. It is thus to be understood that the nozzle 3 may have any suitable shape, including that of a plate structure or a pipette structure.

Figure 5:
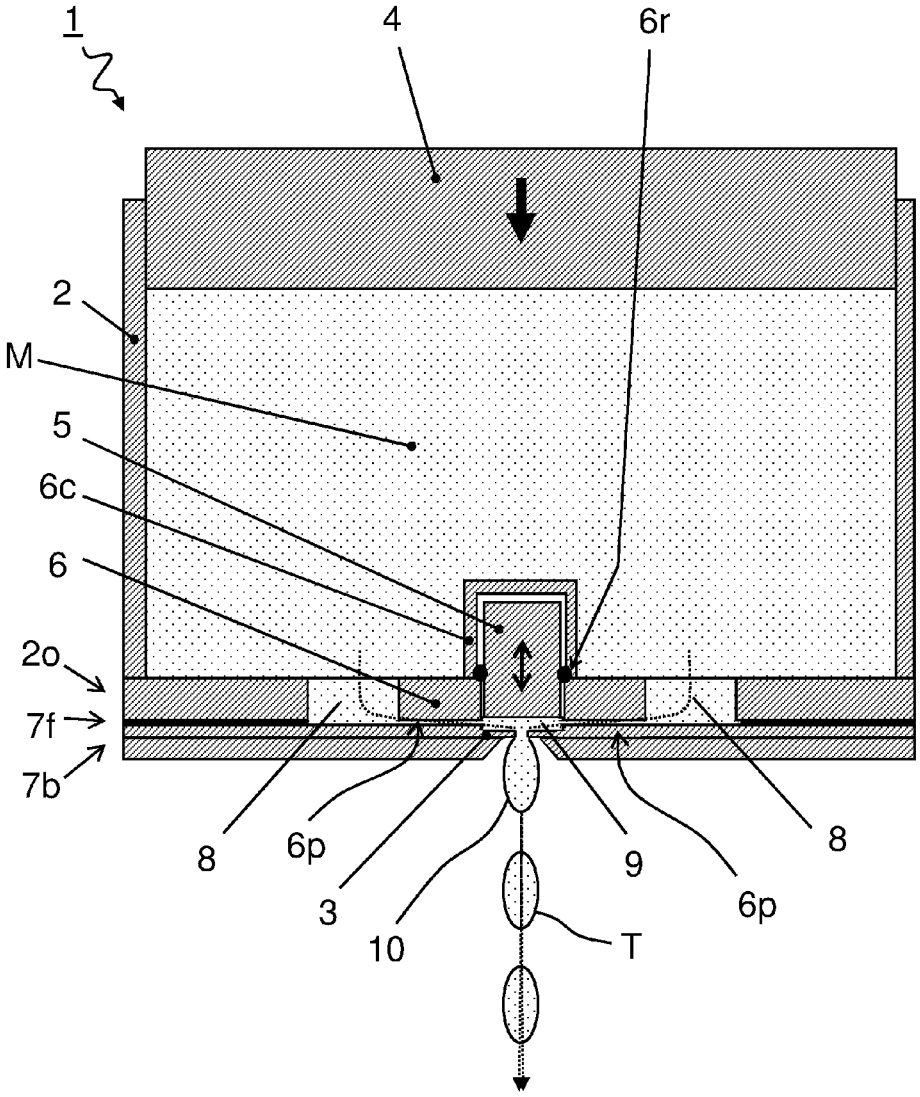
FIG. 5 shows a cross-section view of another embodiment of a continuous jet printing apparatus.

FIG. 5 shows a cross section view of another embodiment of the apparatus 1. In this embodiment the flow restricting structure 6 is formed by a thin foil 7*f* pressed between plate structures 2*o* and 7*b*. The foil comprises a passage forming the restricted passage 6*p*, wherein a (height) dimension of the restricted passage 6*p* is determined by a thickness of the foil 7*f*.

The foil may e.g. have a thickness between 1-100 μm, preferably between 1-10 μm, which may depend on the required flow resistance. Preferably, the foil comprises a flexible material with good sealing capabilities, such polyimide, polyurethane, Fluor based polymer, PE, PET or PEN. The sealing capability of the foil is preferably such that it can withstand the forces exerted by the pressurized fluid material, i.e. preferably the material experiences minimal deformation or shifting. Alternatively, the foil may comprise a thin metal film.

In use, the pressure generating means 4 exerts a pressure on the fluid material M in the reservoir 2. The pressurized material M flows via an inflow opening 8 in the inflow plate 7*a* through the restricted passage 6*p* into an entrance 9 of the micro volume directly adjacent the outflow opening 10 from which opening a jet of material flows along a trajectory T breaking into drops.

The flow restricting structure is thus formed by a combination of the plate structures 2*o* and 7*b* and the foil 7*f* pressed therein between. In particular, a passage where the foil has been removed defines the restricted passage 6*p* between the plate structures 7*a* and 7*b*. The pressure regulating mechanism 5 is arranged in a pin guiding structure 6*c*. The pin guiding structure encloses the pressure regulating mechanism 5 and separates it from the material M in the reservoir. This has an advantage that a pressure of the material in the reservoir does not directly press on the pressure regulating mechanism 5. An end of the pressure regulating mechanism 5 forms an actuating surface that bounds the micro volume together with a surface of the nozzle 3 and adjacent surfaces of the plate structure 2*o*.

In use, the pressure regulating mechanism 5 vibrates towards and away from the outflow opening creating pressure variations in the micro volume that propagate into the emerging jet influencing a breakup into drops. A sealing ring 6*r* may be provided between the pin guide 6*c* and the pressure regulating mechanism 5 to prevent fluid material from entering the pin guide 6*c*. Alternatively or in addition the micro volume may be separated from the pressure varying mechanism by a flexible foil, wherein the actuation of the micro volume occurs through the flexible foil. In particular, the same foil 6*f* may be extended to be arranged between the micro volume and the pressure varying mechanism 5. In this case the actuating surface of the pressure regulating mechanism may be formed by a part of the foil.

Figure 6:
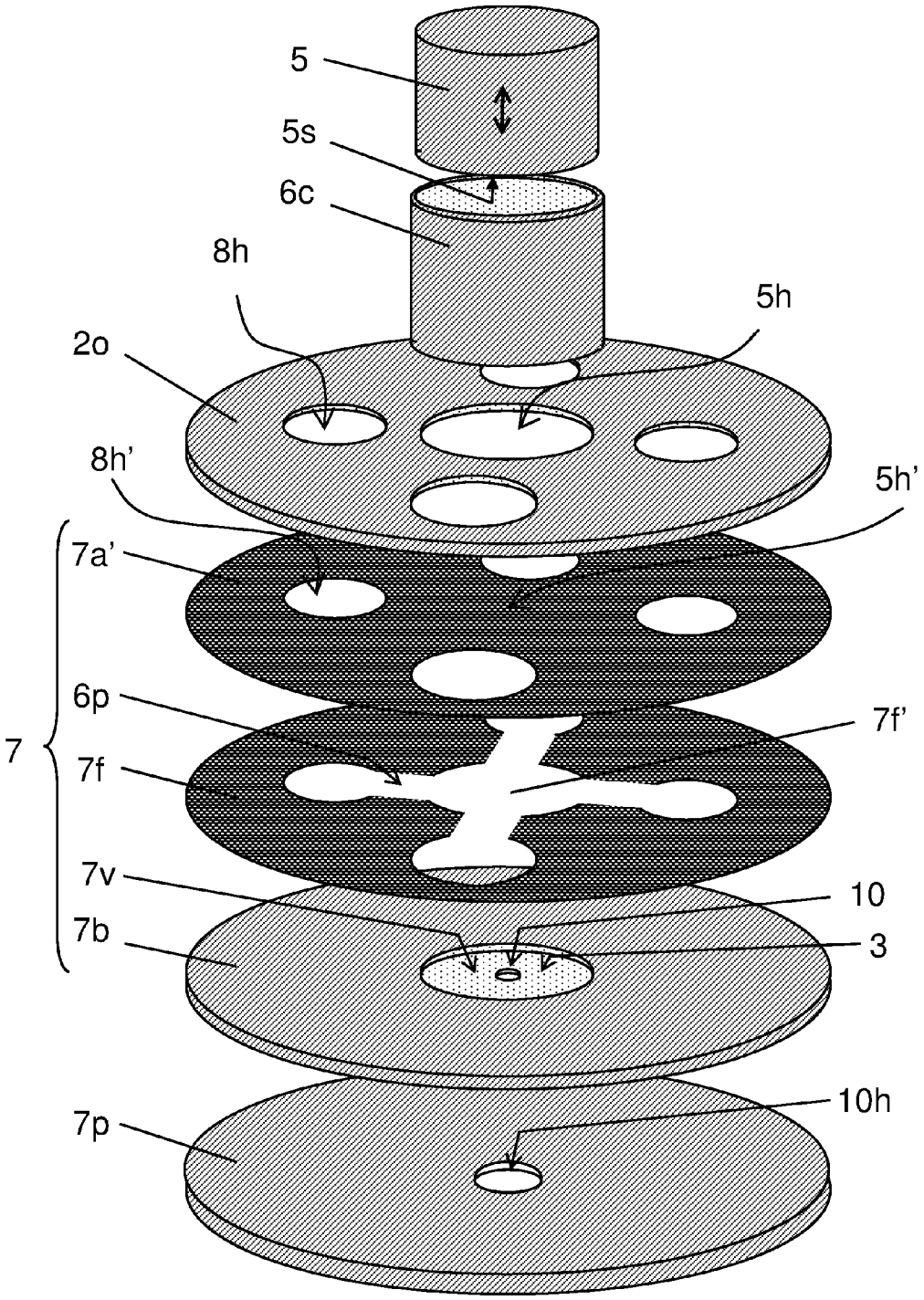
FIG. 6 shows an exploded view a flow restricting structure in the embodiment of FIG. 5.

FIG. 6 shows an exploded view of an embodiment of a nozzle piece 7 for use in a continuous jet printing apparatus as described above. The nozzle piece 7, or part thereof may be provided as a detachable unit. An advantage of this may be that the nozzle piece or part thereof can be easily replaced, e.g. when a restricted passage gets clogged up.

The nozzle piece comprises a nozzle 3 and a flow restricting structure 6. The nozzle 3 comprises an outflow opening 10, from which outflow opening 10, in use, flows a jet of the material breaking up into drops. The flow restricting structure has an inlet 8*h*' that is, in use, in fluid connection with a reservoir (e.g. reservoir plate 2*o*) and an outlet, connected to a micro volume 7*v* directly adjacent an inside of the nozzle 3. The flow restricting structure is arranged for restricting a flow of the material M between the reservoir and micro volume 7*v* by means of a restricted passage 6*p* through the flow restricting structure. The restricted passage 6*p* is dimensioned relative to the outflow opening 10 such that, in use, a pressure drop ΔP1 of the material M over the restricted passage 6*p* between the inlet and outlet is between 0.1 and 10 times a pressure drop ΔP2 of the material M over the outflow opening 10 between the micro volume and an external surroundings of the nozzle 3. The flow restricting structure and the nozzle 3 are arranged to bound the micro volume for the purpose of, guiding or reflecting pressure variations, generated by a pressure regulating mechanism 5 comprising an actuating surface 5*s* arranged near the nozzle 3, towards the outflow opening 10.

In an embodiment the flow restricting structure is formed by a thin foil 7*f*, in use, pressed between plate structures 2*o*,7*b*. The foil comprises a cut out passage 6*p* between the inlet and outlet of the flow restricting structure forming the restricted passage 6*p*, wherein a dimension of the restricted passage 6*p* is determined by a thickness of the foil 7*f*.

In a further embodiment the nozzle piece 7 comprises an optional cover 7*a*' that is arranged to cover the outflow opening 10 and/or restricted passage 6*p* and is flexible at least in an area 5*h*' opposite the outflow opening 10 such that, in use, vibrations of the pressure regulating mechanism 5 in mechanical contact with said area 5*h*' are passed through the cover 7*a*' for generating pressure variations of material M in the micro volume defined e.g. between the cover 7*a*', nozzle 3, and the foil 7*f*.

The nozzle may be comprised in a nozzle plate 7*b*. The cover 7*a*' may comprise a flexible foil or a plate structure. The cover is preferably arranged to cover the nozzle plate 7*b* such that contaminants are prevented from entering the outflow opening 10 and/or restricted passage 6*p*. The cover 7*a*' may comprise an inflow opening 8*h*' that matches the outflow opening 8*h* of the reservoir plate 7*o*. Alternatively, the inflow opening may be closed e.g. by a temporary foil layer until the nozzle piece is attached. Upon attachment, the temporary foil layer covering the inflow opening may be pierced e.g. by a protrusion (not shown) of the reservoir plate 2*o* thus forming the inflow opening. In this way the entire nozzle piece may be closed off when not in use, preventing contaminants to enter the nozzle piece.

Typically the diameter of the outflow opening is between 2 and 400 μm. In a further embodiment the diameter may be between 0.1 and 10 times a thickness of the nozzle plate. As shown the outflow opening 10 is laterally displaced relative to the inflow opening 8*h*' such that the inflow opening and outflow opening are preferably not overlapping each other on the oppositely arranged cover 7*a*' and nozzle plate 7*b*.

In the shown embodiment the nozzle piece 7 comprises a thin foil 7*f* that is to be pressed between the reservoir plate 2*o* and nozzle plate 7*b*. The thin foil 7*f* comprises a passage between the inflow opening 8*h* and the outflow opening 10 forming the restricted passage 6*p*. A (height) dimension of the restricted passage 6*p* is determined by a thickness of the foil 7*f*. An advantage of using such an arrangement of a thin foil pressed between two plates is that it is relatively easy to create any desired flow resistance, simply by choosing a thickness of the foil and/or a width of the cutout passage in the foil forming the restricted passage 6*p*.

In the shown embodiment a volume 7*v* is defined by a partial indentation in the nozzle plate 7*b* surrounding the outflow opening 10. The indentation may define a lower bounding of the micro volume while an upper bounding may be provided by surroundings of the inflow plate around the hole 5*h* and a surface of the pressure regulating mechanism 5. To further prevent fluid material entering or escaping the micro volume by other ways than the restricted passage 6*p* and the outflow opening 10, a guiding cylinder 6*c* may provided that is to be attached on top of the reservoir plate 7*o* and surrounds the pressure varying mechanism 5. Alternatively, the partial indentation in the nozzle plate 7*b* surrounding the outflow opening 10 may be omitted and the micro volume defined e.g. by the space between the cover 7*a*' (which may be a foil) and the nozzle plate or between the space 7*f* that is cut out of the foil 7*f* and pressed between the cover 7*a*' and the nozzle plate 7*b* when the nozzle piece 7 is attached to the reservoir plate 2*o*.

The nozzle piece 7 may be provided with an optional support plate 7*p* that is to be pressed against the nozzle plate 7*b*. Especially when the nozzle plate comprises a thin structure, the support plate may be used for reinforcement against possibly high pressures in the micro volume directly adjacent the outflow opening 10. The support plate is preferably provided with a support plate opening 10*h* having somewhat larger cross section than the outflow opening 10 itself, to prevent adding further flow resistance to the outflow opening 10. Additionally or alternatively, the support plate opening 10*h* may comprise a widening cross-section as was shown e.g. in FIG. 3.

Figure 7A:
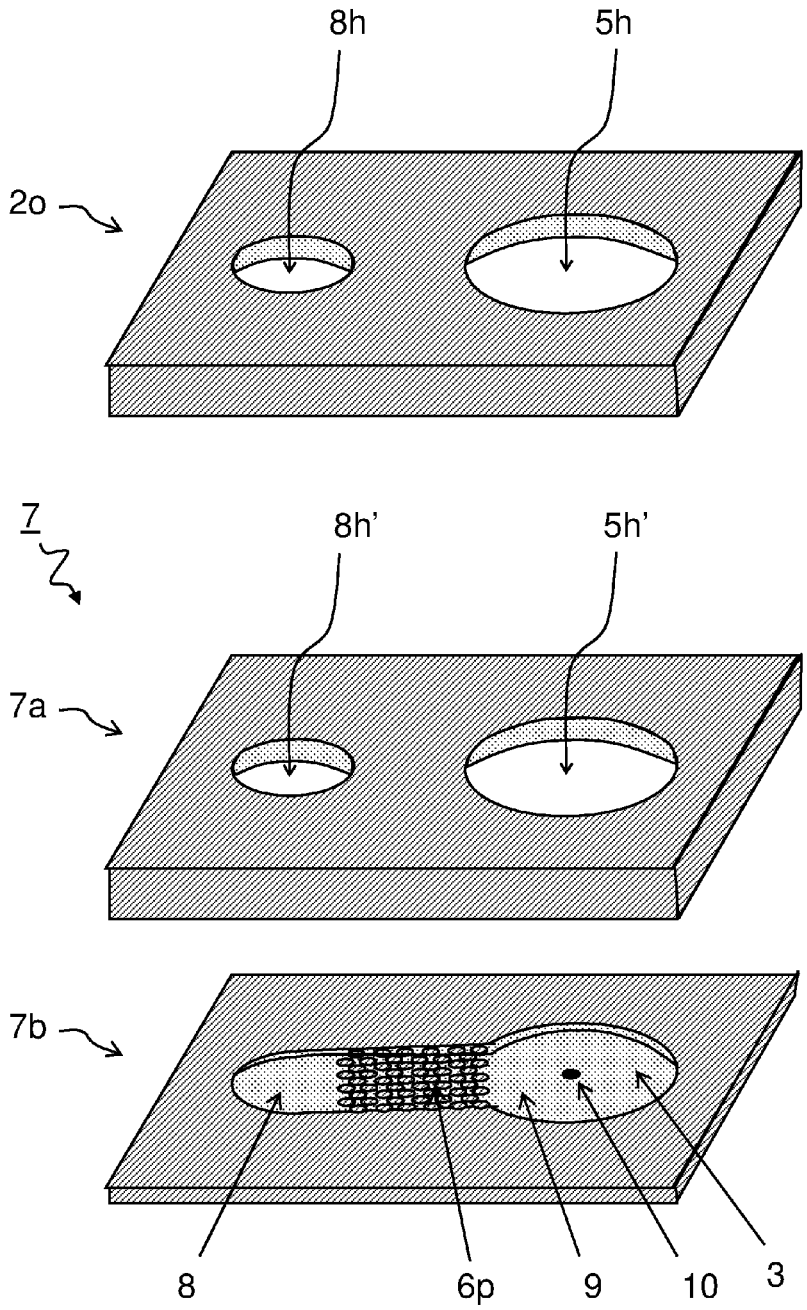
FIGS. 7A and 7B show an exploded view of embodiments of another flow restricting structure.

FIG. 7A shows an exploded view of another embodiment of a nozzle piece 7 for use in a continuous jet printing apparatus as described above. The nozzle piece 7 comprises an inflow plate 7*a* that acts as a cover for the restricted passage 6*p* and an nozzle plate 7*b*. The plates 7*a* and 7*b* are to be pressed together. The inflow plate 7*a* comprises an inflow opening 8*h*; and the nozzle plate 7*b* comprises an outflow opening 10 in a nozzle 3. As shown the outflow opening 10 is laterally displaced relative to the inflow opening 8*h* such that the inflow opening 8*h* and outflow opening 10 are not overlapping each other on the oppositely arranged inflow plate 7*a* and nozzle plate 7*b*.

The nozzle piece further comprises a restricted passage 6*p* defined between the inflow plate 7*a* and the nozzle plate 7*b* such that the inflow opening is in fluid connection with the outflow opening via the restricted passage 6*p*. The restricted passage 6*p*, i.e. its structure, is dimensioned relative to the outflow opening 10 such that, in use, a pressure drop ΔP1 of a printing material M over the restricted passage 6*p* is between 0.1 and 10 times a pressure drop ΔP2 of the material M over the outflow opening 10.

In the shown embodiment, the nozzle plate 7*b* comprises an etched structure of micro channels etched in the nozzle plate 7*b*. The micro channels form the restricted passage 6*p*, wherein a dimension of the restricted passage 6*p* is determined by a depth of the etching structure and a width of the micro channels. In this case the etched structure comprises an array of micro rods wherein a length of the micro rods is determined by a depth of the etched structure and the micro channels are formed between the micro rods. The micro rods may be round but also other shapes are possible, e.g. square, hexagonal, oval, etc.

In an embodiment the flow restricting structure is arranged to function as a filtering mechanism, wherein the flow restricted passage is dimensioned such that particles to be filtered can not pass the flow restricted passage. A typical size of particles to be filtered may depend on the application. The particles to be filtered are e.g. those particles that would get stuck in the outflow opening, i.e. having a diameter comparable to or larger than the outflow opening. E.g. for a flow restricting structure comprising micro rods, the micro rods may be distanced from each other such that the maximum distance between adjacent micro rods is lower than a size, e.g. diameter, of particles to be filtered. For a flow restricting structure comprising a single cross-section opening, the said opening may have a cross-section smaller than a size of particles to be filtered.

In the shown embodiment, the inflow plate 7*a* comprises an actuating opening 5*h* that is arranged opposite the outflow opening 10. The actuating opening 5*h* is dimensioned to fit, in use, an actuating surface of the pressure regulating mechanism 5, shown e.g. in FIG. 7, into the actuating opening thus defining a micro volume directly adjacent the outflow opening 10 between the actuating surface, the nozzle plate and the walls of the actuating opening 5*h*. Optionally, a further flexible cover foil (not shown) may be provided between the plates 7*a* and 7*b* to cover the nozzle and prevent contaminants from entering the outflow opening.

The nozzle piece 7 may be attached in use to a reservoir plate 2*o* comprising openings 8*h* and 5*h* that match the inflow opening 8*h*' and the actuating opening 5*h*' of the inflow plate 7*a*, respectively. In use, material from the reservoir (not shown here) may flow out from the opening 8*h* in the reservoir plate 2*o* into the inflow opening 8*h* of the inflow plate 2*a*, through the restricted passage 6*p* defined between the inflow plate 2*a* and nozzle plate 2*b*, and out of the outflow opening 10 through the nozzle 3.

Figure 7B:
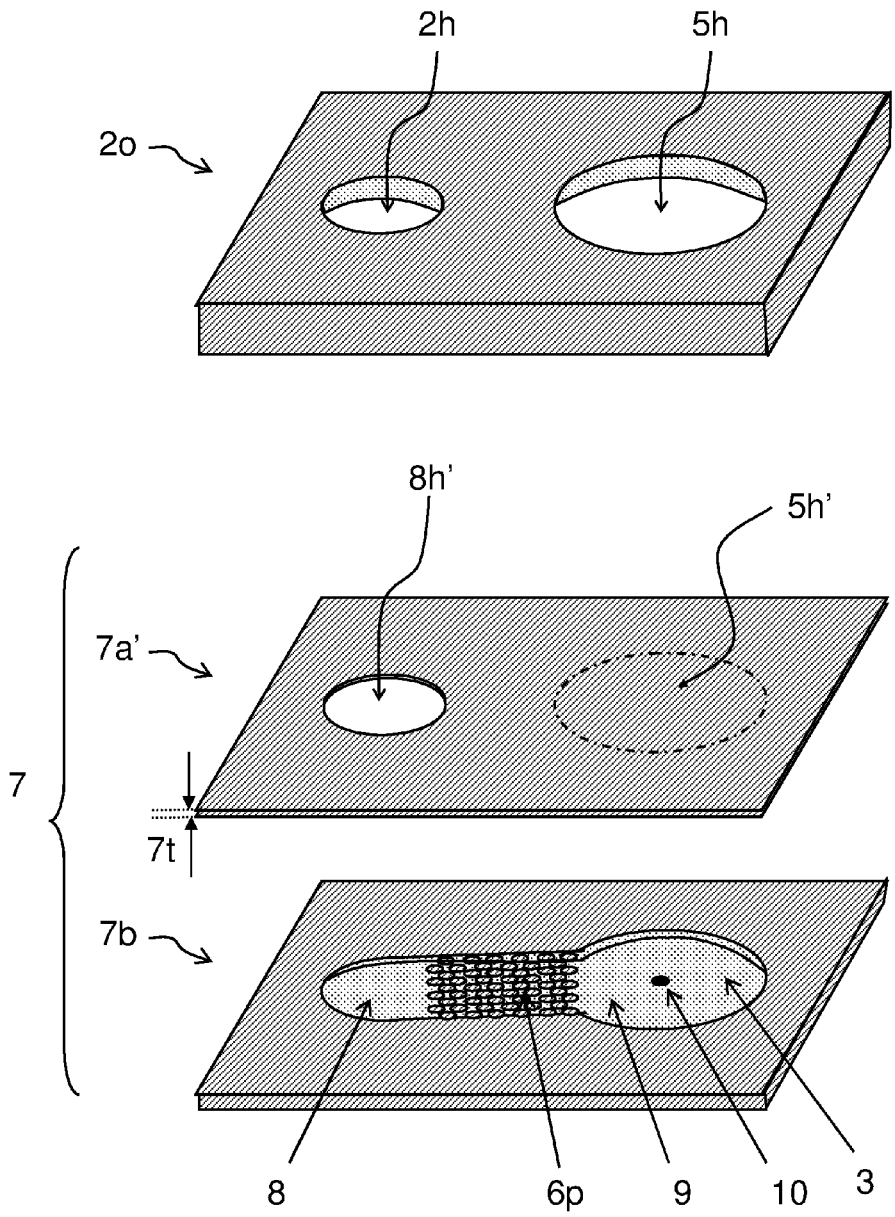

FIG. 7B shows another embodiment of the nozzle piece 7. In this embodiment, the cover 7*a*' is formed by a thin plate structure that is flexible at least in an area 5*h*' opposite the outflow opening 10 such that, in use, vibrations of a pressure regulating mechanism 5 (shown e.g. in FIG. 6) in mechanical contact with said area 5*h*' are passed through the cover 7*a*' for generating pressure variations of material M in a micro volume defined between the inflow plate and nozzle plate directly adjacent the outflow opening 10. The flexibility of the cover 7*a*' may be achieved e.g. by adjusting a thickness 7*t* of the inflow plate. Alternatively or in addition, the material of the inflow plate 7*a* may comprise a flexible material such as foil.

In an embodiment, the nozzle piece 7 may be provided as a detachable unit. In use, the detachable nozzle piece 7 may be connected to an nozzle plate 2*o* which may be part of the reservoir or print head of the printing apparatus (not shown). The plate 2*o* may comprise an outflow opening 2*h* matching the inflow opening 8*h*' of the inflow plate 7*a*', such that, in use, material may flow from the reservoir through the outflow opening 2*h* into the inflow opening 8*h*. The nozzle plate 2*o* may further comprise an opening 5*h* for accommodating the pressure regulating mechanism (not shown) such that in use the pressure regulating mechanism may vibrate through the opening 5*h* in contact with the flexible area 5*h*' of the inflow plate 7*a*' opposite the outflow opening 10.

Figure 8:
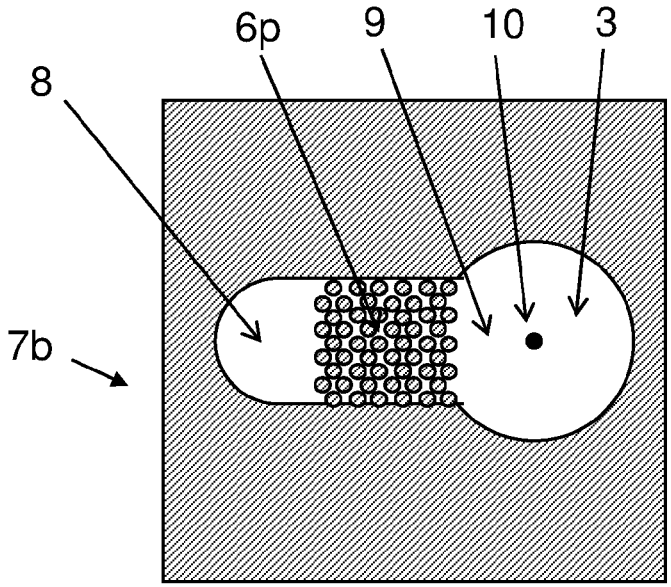
FIG. 8 shows a top view of part of the flow restricting structure of FIGS. 7A and 7B.

FIG. 8 shows a top view of the nozzle plate 7*b* of FIG. 7. In use, fluid material may flow via the recessed entrance 8 (connected to the reservoir, not shown) through the restricted passage 6*p* to the entrance 9 of the micro volume. From the micro volume the fluid may be pressed through the outflow opening 10 in the nozzle 3 while being pressurized by the pressure varying mechanism (not shown). The top view further illustrates how the micro rods may be positioned to define a restricted passage 6*p* therein between. The rods may be created e.g. by lithographic techniques. For example. the whole plate 7*b* may comprise a silicon plate from which the white sections have be partially etched away. The outflow opening may be provided e.g. by laser ablation or other means for creating a through silicon via known by the skilled artisan.

Figure 9:
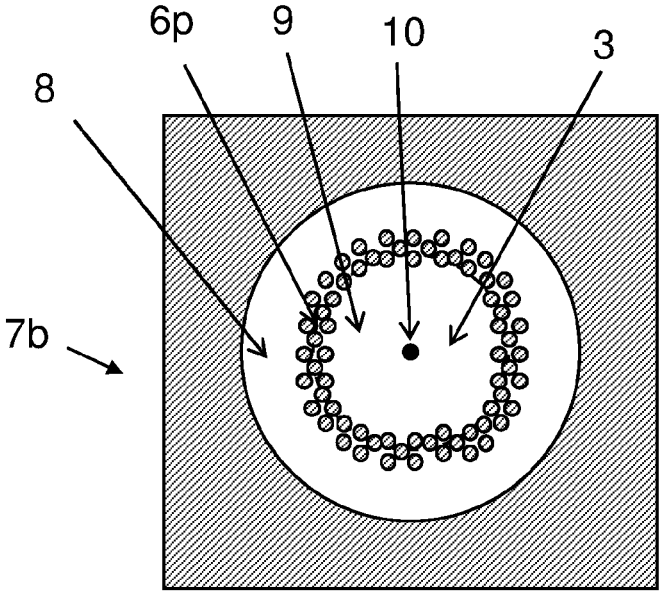
FIG. 9 shows a top view of another flow restricting structure.

FIG. 9 shows a top view of another embodiment for an nozzle plate 7*b* that may be part of a nozzle piece. A difference from the nozzle plate shown in FIG. 8, is that the entrance 8 connected to the reservoir surrounds the micro volume such that, in use, fluid material may flow from all sides between 8 and 9 via the restricted passage 6*p* to the micro volume directly adjacent the outflow opening 10 in the nozzle 3.

FIG. 10A-10D show schematically different continuous jet printing apparatuses and corresponding pressure levels P along a flow path x of the respective apparatuses.

Figure 10A:
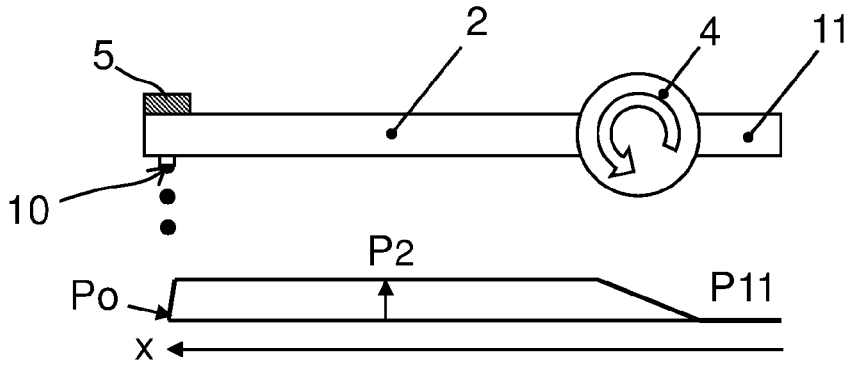
FIG. 10A-10D show different continuous jet printing apparatuses

FIG. 10A shows an apparatus comprising a pressure generating means 4 that receives material from supply 11 with supply pressure P11 and pressurizes this material to a reservoir pressure P2 while passing the material to reservoir 2. From the reservoir 2, the material flows in a direction of the outflow opening 10 and emerges there from as a jet of particles. The ambient pressure outside the apparatus is Po. The material thus experiences a pressure drop P2-Po while flowing out of the outflow opening 10. To regulate the breakup of the jet into drops, the pressure is varied by pressure regulating mechanism 5 in front of the outflow opening. The pressure variations caused by the pressure regulating mechanism 5 in the apparatus of FIG. 10A may travel not only in a direction of the outflow opening 10, but also back into the reservoir where they may dissipate thereby possibly impacting an efficiency of the pressure regulating mechanism 5.

Figure 10B:
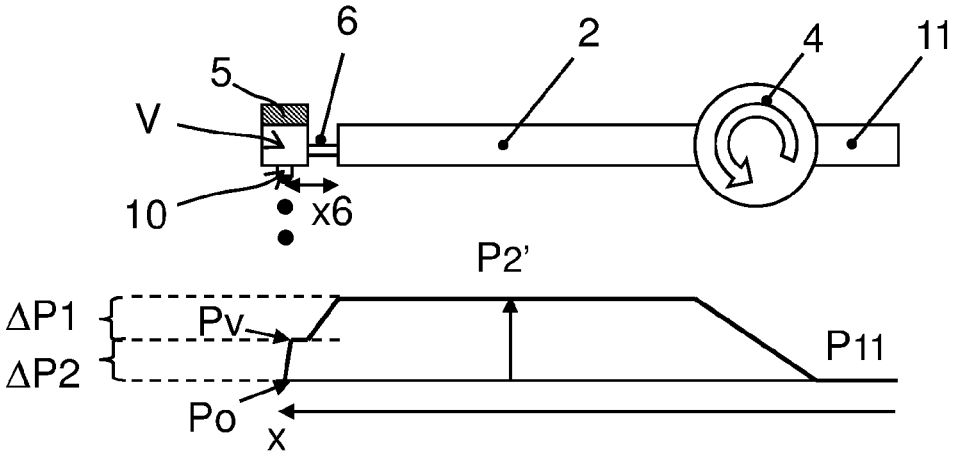

FIG. 10B shows an embodiment wherein a flow restricting structure 6 is provided between reservoir 2 and outflow opening 10. The flow restricting structure 6 bounds a micro volume V directly adjacent an inside of the outflow opening 10 for the purpose of guiding or reflecting pressure variations generated by the pressure regulating mechanism 5 towards the outflow opening 10. In this way an efficiency of the pressure regulating mechanism 5 may be increased compared to FIG. 10A. The flow restricting structure 6 may be characterized e.g. by comparing a pressure drop ΔP1 over the flow restricting structure 6 with a pressure drop ΔP2 over the outflow opening 10. The pressure drop ΔP1 may be equated to the pressure difference between the reservoir pressure P2' and the micro volume pressure Pv. The pressure drop ΔP2 may be equated to the pressure difference between the micro volume pressure Pv and the ambient pressure Po outside of the outflow opening 10.

Preferably, the flow restricting structure 6 is provided in a distance interval x6 measured along a direct flow path to the outflow opening that is less than 20 cm from the outflow opening 10, more preferably less than 2 cm, most preferably less than 0.2 cm. In particular, the smaller this flow path distance x6 to the flow restricting structure 6, the smaller may be the micro volume that is bounded by the flow restricting structure providing less volume for dissipating pressure variations generated by the pressure regulating mechanism 5.

Figure 10C:
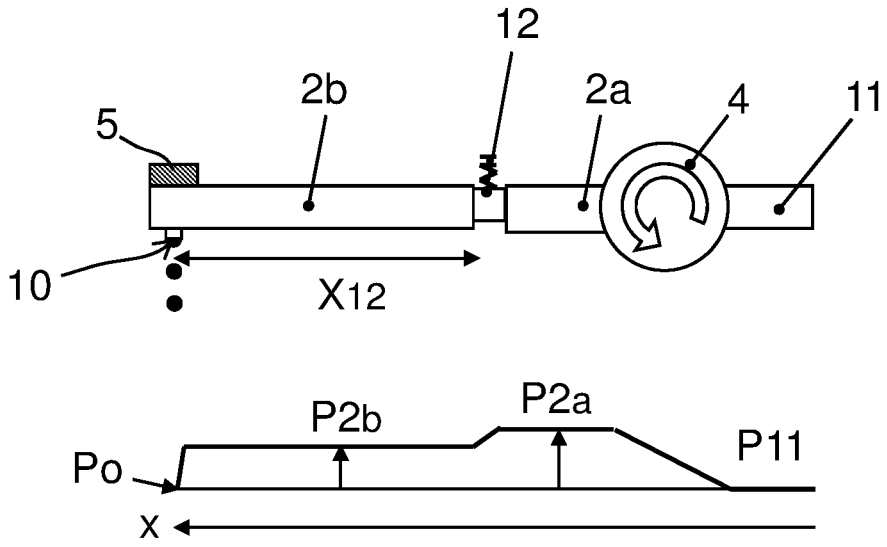

FIG. 10C shows another apparatus similar to FIG. 10A, except that the apparatus additionally comprises a damper 12 in a flow path between the pressure generating means 4 and the outflow opening 10. The damper 12 is arranged for dampening out unwanted pressure variation that may be generated by the pressure generating means 4, e.g. due to moving pistons and the like. Without the damper 12, these unwanted pressure variations may influence the breakup of the jet into drops in an unregulated manner independent of the pressure variations generated by the pressure regulating mechanism 5. The damper 12 may e.g. be a fluid damper that is preferably useful in the relevant high pressure printing pressure ranges and comprises a guiding channel having a wall reinforced by a highly pressurized liquid that absorbs pressure variations. A similar damper was disclosed e.g. in EP1923215 by the current inventors. WO 2004/018212 discloses a pressure damping ink filter having a similar damping function.

The damper 12 is not to be confused with the flow restricting structure 6 as discussed throughout this text. In particular, while the damper 12 may cause a pressure drop P2a-P2b in this case between parts of the reservoir 2*a* and 2*b*, the damper has an entirely different function than the flow restricting structure 6. While the damper 12 is arranged for dissipating pressure variations of the pressure generating means 4, the flow restricting structure 6 may prevent dissipation of the pressure variations caused by the pressure regulating mechanism 5. Furthermore the volume 2*b* is also not to be confused with the micro volume V as discussed throughout this text. In particular, since the damper 12 may be provided preferably close to the pressure generating means 4, e.g. at a distance x12 larger than 20 cm from the outflow opening, it is noted that the reservoir volume 2*b* may far exceed a volume of 10^5 times a desired droplet volume and may therefore not be qualified as a "micro volume". Accordingly in a preferred embodiment there is provided an apparatus wherein the flow restricting structure 6 is arranged at a distance of less than 20 cm from the outflow opening 10.

For the apparatus of FIG. 10C similar as for the apparatus of FIG. 10A, pressure variations caused by the pressure regulating mechanism 5 may travel not only in a direction of the outflow opening 10, but also back into the reservoir 2*b*, 2*a* where they may dissipate thereby possibly impacting an efficiency of the pressure regulating mechanism 5. This dissipation even may be enhanced by the damper 12, whose function is to dampen pressure variations.

To emphasize differences between known dampening filters and the presently disclosed flow restricting structure, it is noted that e.g. the ink filter of WO 2004/018212 is used to dampen pressure variations of a pump as opposed to the presently disclosed flow restricting structure which is used for guiding and reflecting pressure variations generated by the pressure regulating mechanism. The difference in function may be apparent from the differing structure and relative position in the flow chain. With respect to relative position, WO 2004/018212 does not disclose a flow restricting structure bounding a micro volume adjacent the outflow opening, e.g. the volume bound by the restrictors of the ink filter is not directly adjacent an inside of the nozzle. Instead, the ink filter is separated from the nozzle by a pressure transducer and valve. With respect to structure, WO 2004/018212 does not disclose a restricted passage dimensioned relative to the outflow opening such that, in use, a pressure drop of the material over the restricted passage between the inlet and outlet is between 0.1 and 10 times a pressure drop of the material over the outflow opening between the micro volume and an external surroundings of the nozzle. WO 2004/018212 does not disclose anything about the relative pressure drop over a flow restricting structure near the nozzle compared to the outflow opening of the nozzle. While, WO 2004/018212 discloses that the input restrictor and the output restrictor of the ink filter may both have a diameter of about 1/32 inch, the output restrictor of the ink filter is not an the outflow opening of a nozzle from which outflow opening, in use, flows a jet of the material breaking up into drops. The ink filter of WO 2004/018212 does not achieve advantages of the present disclosure, e.g. enhancing the amplitude of pressure waves reaching the outflow opening without further increasing stress on the pressure regulating mechanism.

Figure 10D:
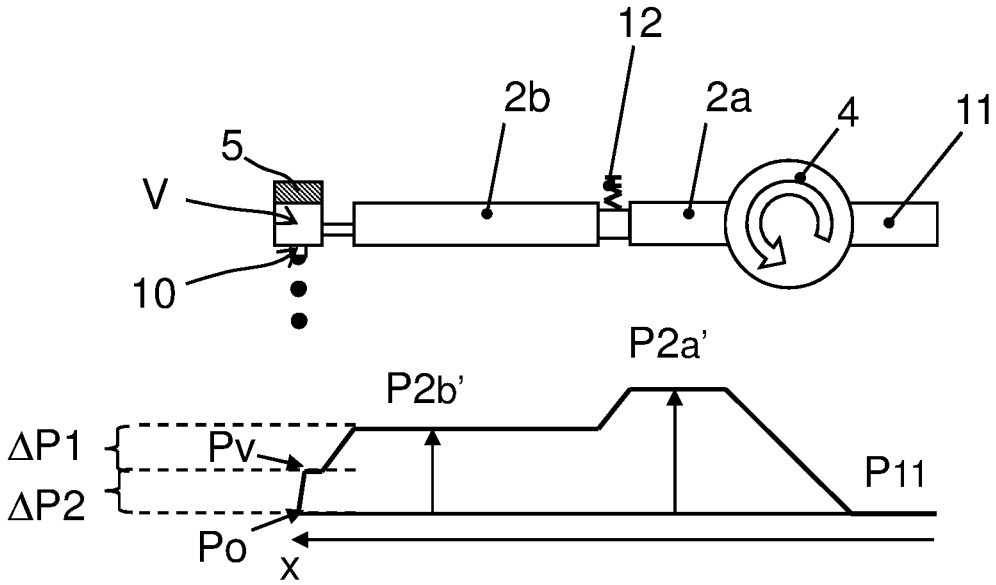

FIG. 10D shows an embodiment wherein a flow restricting structure 6 is provided between reservoir 2 and outflow opening 10 in addition to the damper 12 provided between parts of the reservoir 2*a* and 2*b* the damper 12 may cause a pressure drop P2a'-P2b' between parts of the reservoir 2*a* and 2*b*. The flow restricting structure 6 bounds a micro volume V directly adjacent an inside of the outflow opening 10 for the purpose of guiding or reflecting pressure variations generated by the pressure regulating mechanism 5 towards the outflow opening 10. In this way efficiency of the pressure regulating mechanism 5 may be increased compared to FIG. 10C. The flow restricting structure 6 may be characterized e.g. by having a pressure drop ΔP1 of a similar order as a pressure drop ΔP2 over the outflow opening while the flow restricting structure bounds a micro volume V directly adjacent the outflow opening 10.

Figure 11A:
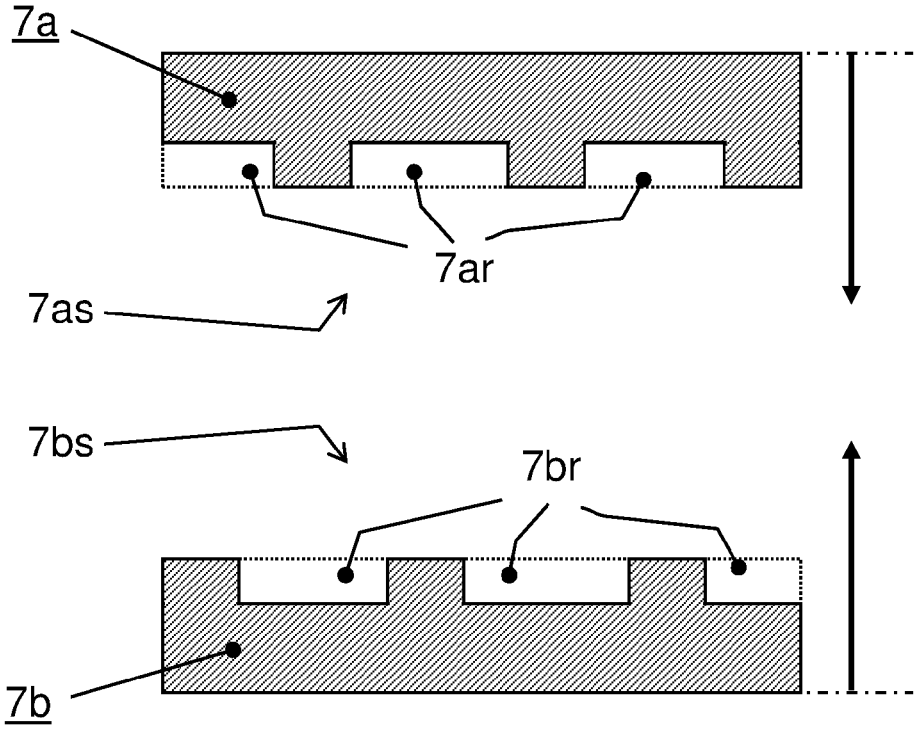
FIGS. 11A and 11*b* show an embodiment of a flow restricting structure for use in a continuous jet printing apparatus and/or nozzle piece.
Figure 11B:
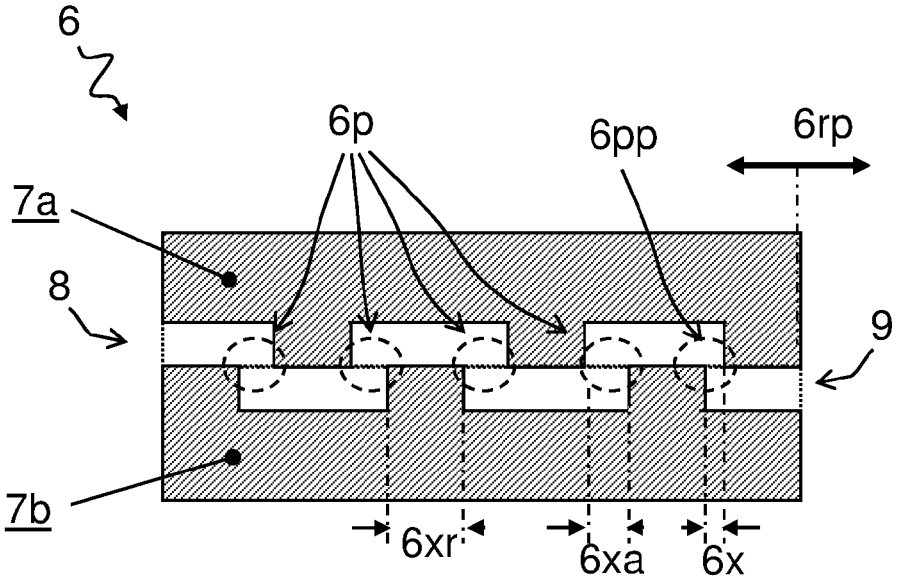

FIGS. 11A and 11*b* show an embodiment of a flow restricting structure 6 for use in a continuous jet printing apparatus and/or nozzle piece as described herein.

FIG. 11A shows a first plate structure 7*a* having a first structured surface 7*as* comprising recesses and/or protrusions 7*ar*. Furthermore a second plate structure 7*b* is shown having a second structured surface 7*bs* comprising recesses and/or protrusions 7*br*.

FIG. 11B shows that, in use, the first plate structure 7*a* and the second plate structure 7*b* are connected together to form the flow restricting structure 6. In the connected flow restricting structure 6, the first structured surface 7*as* faces the second structured surface 7*bs*. The recesses and/or protrusions 7*ar* are relatively displaced with respect to the recesses and/or protrusions 7*br* on the opposing surfaces 7*as* and 7*bs* forming one or more flow restricting passages 6*p* between overlapping surface regions of the recesses and/or protrusions 7*ar* and the recesses and/or protrusions 7*br*.

It will be appreciated that a dimension 6*x* of the one or more flow restricting passages 6*p* can be determined by a relative position 6*rp* of the first plate structure 7*a* with respect to the second plate structure 7*b* along the first and second structured surfaces 7*as*, 7*bs*, e.g. by a sort of interference or interplay between the recesses and/or protrusions 7*ar* of the first structured surface 7*as* and the recesses and/or protrusions 7*br* of the second structured surface 7*bs*. An advantage of this is that a relatively narrow flow restricting passage 6*p* can be created using a combination of relatively course structures, in this case the recesses 7*ar* and 7*br*. In other words a dimension of the flow restricting passage 6*p* may be smaller than the dimensions of the recesses and/or protrusions 7*ar* and 7*br* on the respective structured surfaces 7*as* and 7*bs*. In one embodiment, a dimension 6*x* of the narrowest more flow restricting passages 6*pp* created between the recesses and/or protrusions 7*ar* and 7*br* is less than half a dimension 6*xr* of the recesses and/or protrusions 7*ar* and 7*br* themselves.

This enables a wider variety of materials to be used for forming a flow restricting structure, in particular also materials that could otherwise not be structured beyond a certain minimum dimension or only with great effort, e.g. ceramic materials. Also a wider variety of structuring method may be enabled by the concept of combining two relatively displaced structures, e.g. methods such as milling, grinding and/or cutting may be restricted by a minimal dimension of the tools used for said methods. In one embodiment, the flow restricting structure comprises ceramic material. This could make the flow restricting structure e.g. suitable for printing metals. Particularly advantageous materials may be Zirconium-dioxide, Aluminum-oxide, or nitride variants thereof, as well as Boron-nitride due to their desirable properties that they are resistant to molten metals, not forming a connection therewith.

In one embodiment, the final flow restricting passage 6*pp* that leads to the entry 9 of the micro volume is more narrow than the other passages 6*p*, i.e. passage dimension 6*x* is smaller than e.g. passage dimension 6*xa*. The final passage 6*pp* may be thus arranged in particular for preventing, e.g. by reflection, pressure waves from flowing back through the flow restriction. The other flow restricting passages 6*p* may be more suitable e.g. for providing a filtering function of the fluid material. In one embodiment, the flow restricting passages 6*p* have a gradient of ever more narrow passages towards the outflow opening.

Figure 12A:
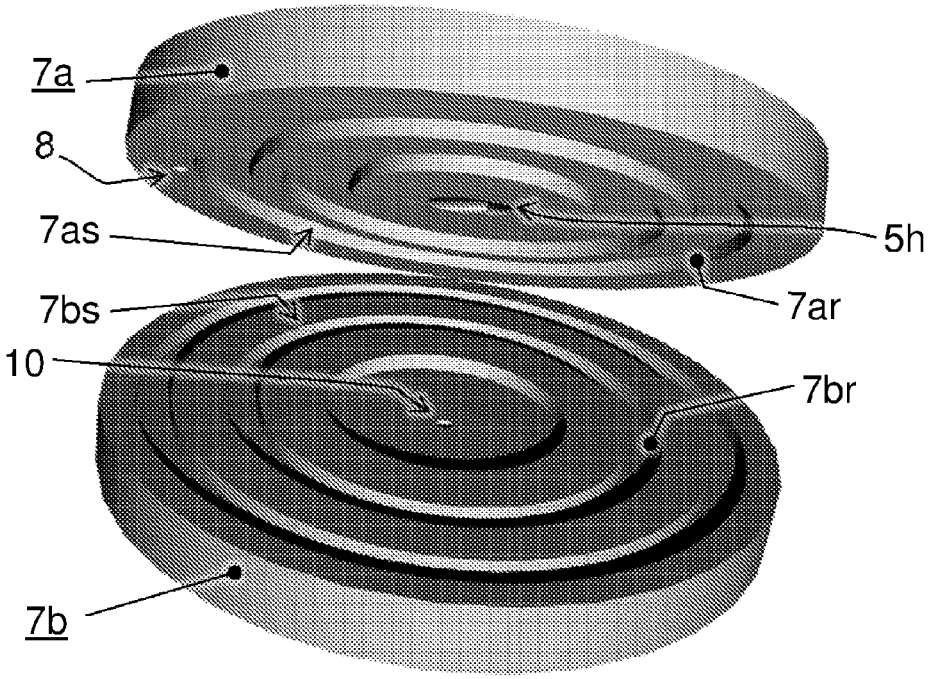
FIGS. 12A and 12B show a flow restricting structure implemented in a nozzle piece.
Figure 12B:
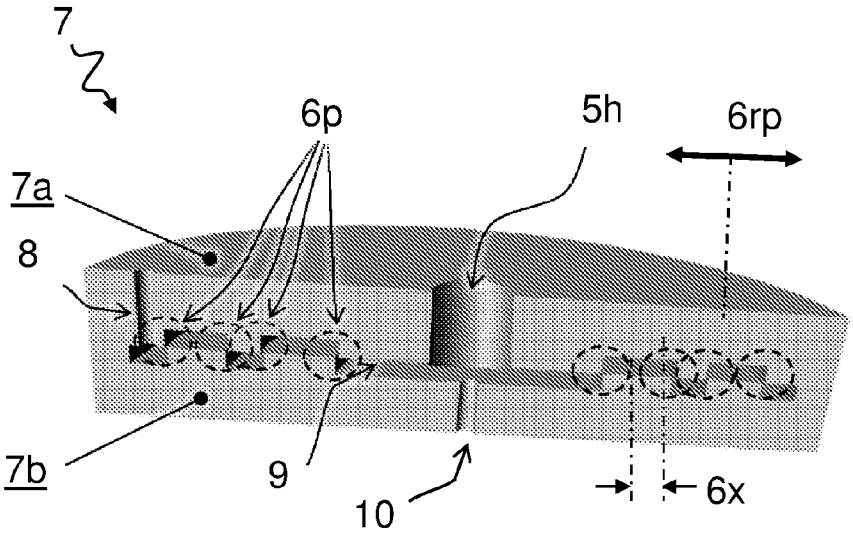

FIGS. 12A and 12B demonstrate how such a flow restricting structure 6 may be implemented e.g. in a nozzle piece 7. FIG. 12A shows an exploded view of the bottom side of a first plate structure 7*a* and a top side of a second plate structure 7*b*. The first plate structure 7*a* comprises a first structured surface 7*as* having a ring-like structure of recesses 7*ar*. These recesses fit together with the recesses on the second structured surface 7*bs* of the second plate structure 7*b* to form the flow restricting passages 6*p* of the flow restricting structure. In use, the first plate structure 7*a* and second plate structure 7*b* are connected together to form the nozzle piece 7 with the flow restricting structure therein. By relative translation and/or rotation of the two two plate structure 7*a* and 7*b*, the flow restricting passages 6*p* may be varied. For example, when the rings in one or both of the plate structures 7*a* and/or 7*b* are not concentric, a relative rotation between the structures can be used to widen or tighten the flow restricting passages 6*p*. Another example of a non-concentric structure is shown in FIGS. 13A and 13B.

In use, fluid material may flow under pressure generated by the pressure generating means (not shown) from an exit point 8 of the reservoir (or fluid guiding means connected to the reservoir) through the restricted passage 6*p* to an entry point 9 of the micro volume and then out of the outflow opening 10. As shown, the nozzle piece 7 optionally comprises an opening 5*h* e.g. for accepting a pressure regulating mechanism to vibrate through the opening as shown previously in FIGS. 5 and 6. Instead of an opening, e.g. also a flexible area could be used for passing the vibrations to the micro volume directly adjacent the outflow opening 10, e.g. as was shown in FIG. 7B, wherein an area above the outflow opening 10 may function as a membrane.

Figure 13A:
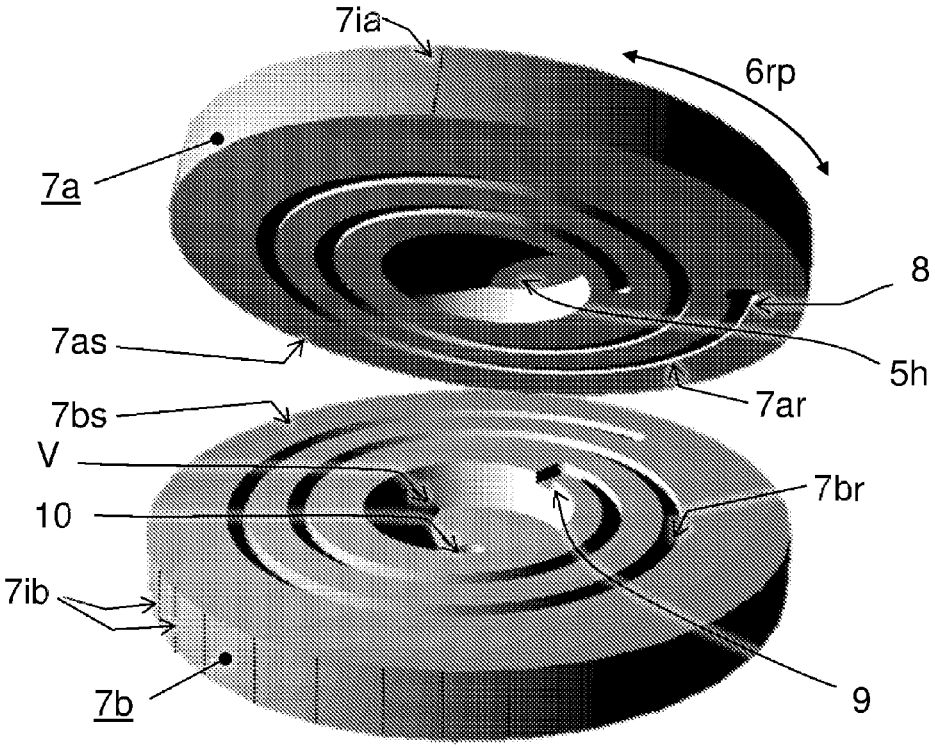
FIGS. 13A and 13B show another embodiment of a flow restricting structure.
Figure 13B:
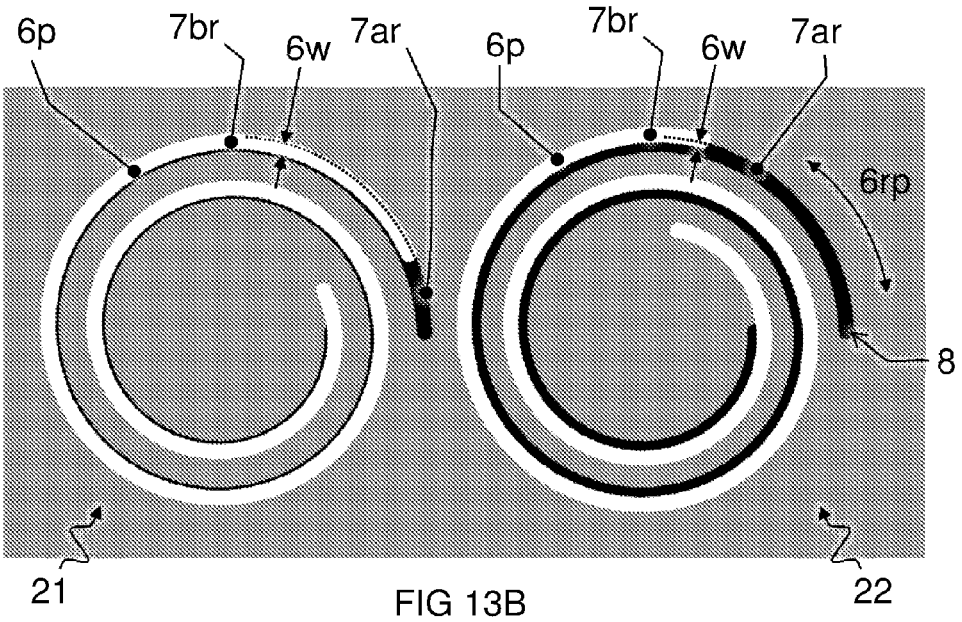

FIG. 13A shows another embodiment of plate structures 7*a* and 7*b* that together may form a variable flow restricting structure. In particular, the opposing structured surfaces 7*as* and 7*bs* comprise spiral shaped recesses 7*ar* and 7*br* that together may form a flow restricting passage 6*p*. FIG. 13B schematically shows a top view of the spiral shaped recesses 7*ar* and 7*br*. Numerals 21 and 22 show two different relative orientations between the plate structures 7*a* and 7*b*. As shown, depending on a rotation 6*rp* between the plate structures 7*a* and 7*b*, a dimension 6*w* of a flow restricting passage 6*p* formed between overlapping part of the recesses 7*ar* and 7*br* may be changed. For example, the spirals indicated by reference numeral 22 have a smaller overlap than the spirals of indicated by reference numeral 21 and thus form a more restricted passage 6*p*. In one embodiment, the two plate structures 7*a* and 7*b* may be rotated with respect to each other up to an angle of 180 degrees plane angle to create a passage 6*p* with variable groove width 6*w* e.g. ranging from a width of the grooves 7*ar*, 7*br*, down to zero. In one embodiment, a groove width of each of the spirals 7*ar* and 7*br* is around 4 millimeters while a width 6*w* of the restricted passage 6*p* is on the order of tens of microns or less. It will be appreciated that a groove width of 4 mm may be more easily manufactured e.g. by milling, than a passage on the order of tens of microns. In one embodiment, the plate structures 7*a* and/or 7*b* comprise an indication 7*ia*, 7*ib* for determining a relative rotation angle between them, e.g. one or both plate structures may comprises one or more grooves 7*ia*, 7*ib* on an external circumference thereof to allow a user to determine a relative angle 6*rp* between the structures. For example, a plurality of indicator grooves 7*ib* may be arranged on the outside of the plate structures to indicate one or more settings for a width of the restricted passage 6*p*.

In use, fluid material may flow between exit point 8 of the reservoir through the flow restricting passage 6*p* to entry point 9 of the micro volume V. The material may exit the micro volume V through outflow opening 10 while being actuated by a pressure regulating mechanism (not shown here) that may act via opening 5*h* on the micro volume V. Advantageously, because the spiral shaped recesses may form a relatively stretched out passage 6*p* between them, this may help to keep sufficient flow capacity when any part of the passage gets clogged, e.g. by particles in the fluid material. A further advantage may be that a passage 6*p* created by overlapping parts of the opposing spiral structures can have a uniform width over a length of the passage.

Figure 14A:
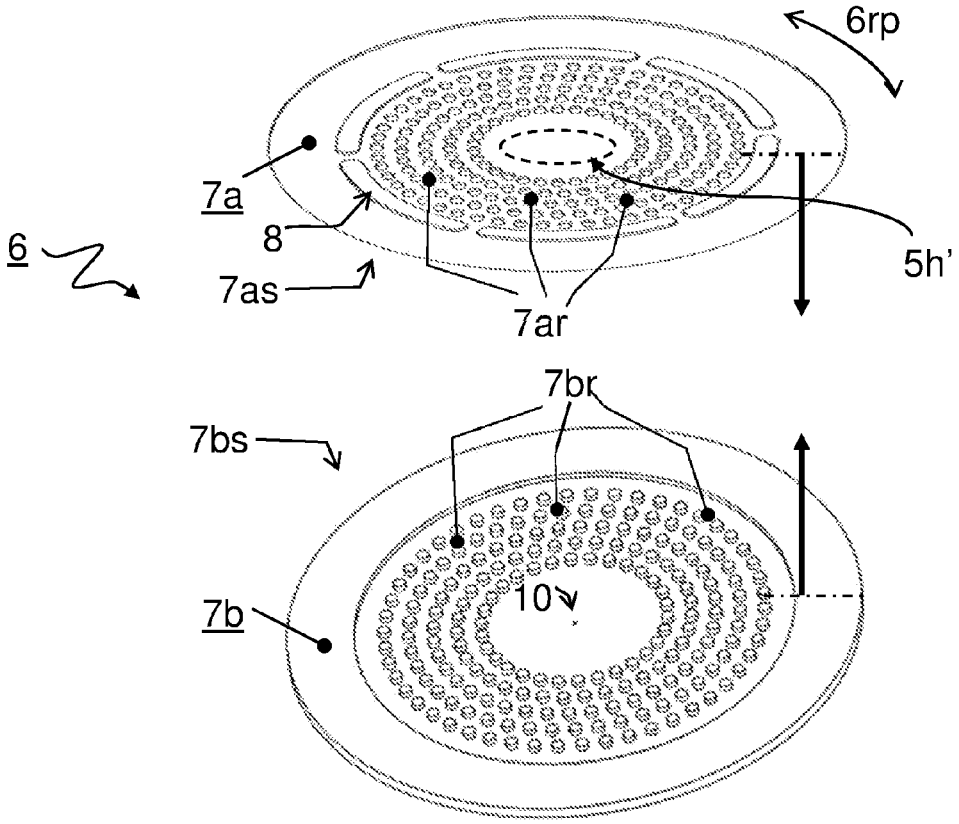
FIGS. 14A and 14B show another embodiment of a flow restricting structure
Figure 14B:
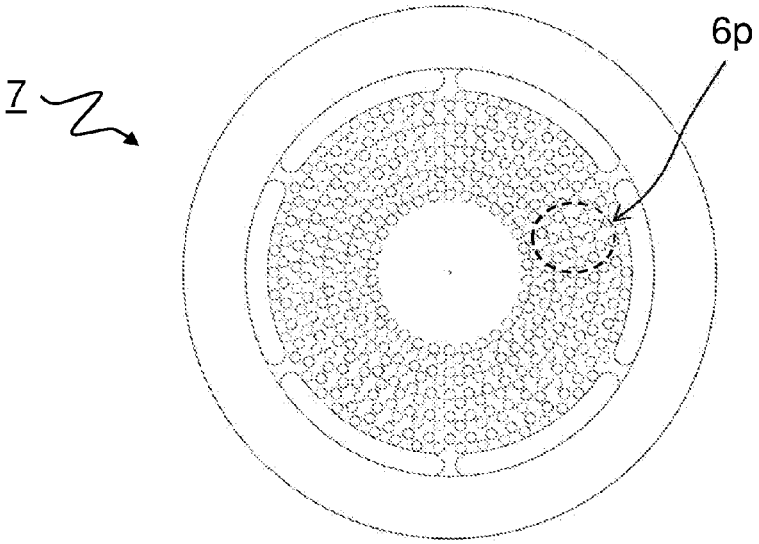

FIG. 14A shows another embodiment of a flow restricting structure for use in a continuous jet printing apparatus and/or nozzle piece as described herein. The flow restricting structure 6 comprises a first plate structure 7*a* having a first structured surface 7*as* comprising recesses and/or protrusions 7*ar* (shown from below) and a second plate structure 7*b* having a second structured surface 7*bs* comprising recesses and/or protrusions 7*br* (shown from the top). In use, the plate structures 7*a* and 7*b* are connected together wherein the structured surfaces 7*as* and 7*bs* face each other. The rods of the first plate structure 7*a* protrude from the plane of the first structured surface 7*as* and are in use arranged in between the rods of the second structured surface 7*bs*. Together, the rods form a flow restricting passage therein between. The rod structures may be relatively displaced with respect to each other e.g. by rotating and/or translating the first plate structure 7*a* with respect to the second plate structure 7*b* (e.g. as indicated by arrow 6*rp*). In this way a dimension of a flow restricting passage 6*p* formed between rods of the first plate structure 7*a* and second plate structure 7*b* may be varied. The first plate structure 7*a* is arranged for in use connecting the flow restricting structure 6 to an exit point 8 of the fluid reservoir. The fluid material may enter the flow restricting structure under pressure and flow through the rod structure towards the outflow opening 10. As indicated by the area 5*h*', the first plate structure 7*a* may comprise an area that acts as a membrane to pass vibrations of a pressure regulating mechanism (not shown here) at the upper side of the first plate structure 7*a*, similar as explained in FIG. 7B. Alternatively, the first plate structure 7*a* may comprise a hole 5*h* as was shown e.g. in FIGS. 12A and 12B FIG. 14B shows a (transparent) top view of the resulting combined flow restricting structure 6 wherein the rods of the first structured surface are placed in between the rods of the second structured surface to form the flow restricting passage 6*p* therein between.

An aspect of the current teachings may be to substantially prevent a backflow of the actuated material, or at least pressure variations therein, in front of the outflow opening. Known systems may not provide a solution for maintaining a constant flow on the time scale (e.g. 20 kHz fluctuations) that may be necessary for increasing the actuation efficiency. The currently proposed addition of a flow restrictor just before the actuating element may provide this solution. The total supply pressure of the system may increase because of this, however the pressure drop of the active part, i.e. below the actuating element may remain the same while an efficiency of the actuating may increase by as much as an order of magnitude. While the required force of the actuating element, e.g. a piezo may increase somewhat, this is still significantly less than other solutions e.g. increasing a size of the actuating element. In this way an increased range of viscosity and/or flow rates may become accessible.

The various elements of the embodiments as discussed and shown offer certain advantages, such as providing a continuous jet printing apparatus. Of course, it is to be appreciated that any one of the above embodiments or processes may be combined with one or more other embodiments or processes to provide even further improvements in finding and matching designs and advantages. It is appreciated that this invention offers particular advantages for systems for printing viscous materials, and in general can be applied for any apparatus wherein a mono disperse jet of droplets needs to be created from a fluid having a high viscosity and/or at high flow rates. In that sense the term "printing" may be construed broadly as any application wherein a fluid material is ejected under pressure from at least one outflow opening as a jet breaking up into droplets.

Examples of applications for an apparatus as disclosed may include e.g. spray drying applications wherein a fluid is broken up into (mono disperse) droplets and a material dissolved in the fluid is dried in a drying medium, e.g. to create a powder of the said material. An example of this is the creation of powdered milk. Another application may be an apparatus for printing of metals e.g., Sn, Gd, Cu, Au, Ag for creation of metal tracks, or usage in radiation sources. The increased working range of viscosities provided by the current apparatus, may find further application in 2D and 3D printing applications. The range of materials that may be printed with the current apparatus may extend also to very high viscosity materials, e.g. of 1000 mPa·s or higher such as longer polymer chains, which in turn may lead to better properties for the 2D or 3D printed products. Also 'dryer' fluids, e.g. containing less water, may be spray dried, leading to increased productivity for a spray drying apparatus. Further applications may include those wherein a flammable fluid is broken up into (mono disperse) droplets and a chemical heat reaction leads to combustion, for propulsion.

Finally, the above-discussion is intended to be merely illustrative of the present system and should not be construed as limiting the appended claims to any particular embodiment or group of embodiments. Thus, while the present system has been described in particular detail with reference to specific exemplary embodiments thereof, it should also be appreciated that numerous modifications and alternative embodiments may be devised by those having ordinary skill in the art without departing from the broader and intended spirit and scope of the present system as set forth in the claims that follow. The specification and drawings are accordingly to be regarded in an illustrative manner and are not intended to limit the scope of the appended claims.

In interpreting the appended claims, it should be understood that the word "comprising" does not exclude the presence of other elements or acts than those listed in a given claim; the word "a" or "an" preceding an element does not exclude the presence of a plurality of such elements; any reference signs in the claims do not limit their scope; several "means" may be represented by the same or different item(s or implemented structure or function; any of the disclosed devices or portions thereof may be combined together or separated into further portions unless specifically stated otherwise; no specific sequence of acts or steps is intended to be required unless specifically indicated; and no specific ordering of elements is intended to be required unless specifically indicated.

What is claimed is:

1. An apparatus for printing a fluid material by continuous jet printing technique, comprising a reservoir for storing the material;

a nozzle comprising an outflow opening, from which said outflow opening, in use, flows a jet of the material breaking up into drops;

a pressure generator arranged for applying a pressure on the reservoir for passing the material under pressure from the reservoir in a direction of the outflow opening;

a pressure regulating mechanism comprising an actuating surface arranged near the outflow opening for providing pressure variations of the material by vibration of the actuating surface for the purpose of obtaining a controlled breakup of the jet into drops; wherein the apparatus further comprises a flow restricting structure having an inlet, in use, in fluid connection with the reservoir, and an outlet, connected to a micro volume directly adjacent an inside of the nozzle, the flow restricting structure arranged for restricting a flow of the material between the reservoir and micro volume by a restricted passage through the flow restricting structure; wherein the restricted passage is dimensioned relative to the outflow opening such that, in use, a pressure drop of the material over the restricted passage between the inlet and outlet is between 0.1 and 10 times a pressure drop of the material over the outflow opening between the micro volume and an external surroundings of the nozzle; and wherein the flow restricting structure and the nozzle are arranged to bound the micro volume for the purpose of, guiding or reflecting pressure variations, generated by the pressure regulating mechanism, towards the outflow opening.

2. The apparatus according to claim 1, wherein the pressure regulating mechanism comprises a control pin wherein an end of the control pin forms the actuating surface opposite the nozzle, which control pin is arranged to vibrate at least partially inside a pin guide additionally bounding said micro volume.

3. The apparatus according to claim 1, wherein the pressure regulating mechanism comprises a vibrating ring surrounding the micro volume wherein an inside of the ring forms the actuating surface.

4. The apparatus according to claim 1 wherein the flow restricting structure is arranged at a distance of less than 20 cm from the outflow opening.

5. The apparatus according to claim 1, wherein the flow restricting structure is formed by a thin foil, in use, pressed between plate structures the foil comprising a cut out passage between the inlet and outlet of the flow restricting structure forming the restricted passage, wherein a dimension of the restricted passage is determined by a thickness of the foil.

6. The apparatus according to claim 1, wherein the flow restricting structure is formed by an etching structure of micro channels, the micro channels forming the restricted passage, wherein a dimension of the restricted passage is determined by a depth of the etching structure and a width of the micro channels.

7. The apparatus according to claim 1, wherein the flow restricting structure comprises a first plate structure having a first structured surface comprising recesses and/or protrusions; and a second plate structure having a second structured surface comprising recesses and/or protrusions; wherein, in use, the first plate structure and the second plate structure are connected together with the first structured surface and the second structured surface facing each other to form the flow restricting structure therein between; wherein a dimension of the one or more flow restricting passages is determined by a relative position of the first plate structure with respect to the second plate structure along the first and second structured surfaces.

8. The apparatus according to claim 1, wherein the nozzle comprises a converging pipette shape in a flow direction of the material.

9. The apparatus according to claim 1, wherein the flow restricting structure and the actuating surface are near the outflow opening such that the micro volume has a volume between 10 to 10E5 times a desired droplet volume.

10. The apparatus according to claim 1, wherein an effective cross-section of the restricted passage is between 0.1 and 10 times that of the outflow opening.

11. The apparatus according to claim 1, wherein a first pressure gradient in the restricted passage and a second pressure gradient in the outflow opening have a ratio between 0.1 and 10.

12. The apparatus according to claim 1, wherein the nozzle and flow restricting structure are comprised in a nozzle piece that is detachable from the reservoir.

13. A nozzle piece for printing a fluid material by a continuous jet printing technique, comprising a nozzle comprising an outflow opening, from which said outflow opening, in use, flows a jet of the material breaking up into drops; wherein the nozzle piece further comprises a flow restricting structure having an inlet, in use, in fluid connection with a reservoir, and an outlet, connected to a micro volume directly adjacent an inside of the nozzle, the flow restricting structure arranged for restricting a flow of the material between the reservoir and micro volume by a restricted passage through the flow restricting structure; wherein the restricted passage is dimensioned relative to the outflow opening such that, in use, a pressure drop of the material over the restricted passage between the inlet and outlet is between 0.1 and 10 times a pressure drop of the material over the outflow opening between the micro volume and an external surroundings of the nozzle; and wherein the flow restricting structure and the nozzle are arranged to bound the micro volume for the purpose of, guiding or reflecting pressure variations, generated by a pressure regulating mechanism comprising an actuating surface arranged near the nozzle, towards the outflow opening.

14. The nozzle piece according to claim 13, comprising a cover that is arranged to cover the outflow opening and/or restricted passage and is flexible at least in an area opposite the outflow opening such that, in use, vibrations of the pressure regulating mechanism in mechanical contact with said area are passed through the cover for generating pressure variations of material in the micro volume.

15. The nozzle piece according to claim 13, wherein the flow restricting structure is formed by a thin foil, in use, pressed between plate structures the foil comprising a cut out passage between the inlet and outlet of the flow restricting structure forming the restricted passage, wherein a dimension of the restricted passage is determined by a thickness of the foil.

16. The nozzle piece according to claim 13, wherein the flow restricting structure is formed by an etching structure of micro channels, the micro channels forming the restricted passage, wherein a dimension of the restricted passage is determined by a depth of the etching structure and a width of the micro channels.

17. The nozzle piece according to claim 16, wherein the etching structure comprises an array of micro rods wherein a length of the micro rods is determined by a depth of the etching structure and the micro channels are formed between the micro rods.

18. A method for printing a fluid material using a continuous jet printing technique, using an apparatus comprising:

a reservoir for storing the material;

a nozzle comprising an outflow opening in fluid connection with the reservoir;

a pressure generator;

a pressure regulating mechanism comprising an actuating surface arranged near the outflow opening;

the method comprising using the pressure generator for applying a pressure on the reservoir and passing the material under pressure from the reservoir in the direction of the outflow opening such that a jet of the material flows from the outflow opening breaking up into drops;

using the pressure regulating mechanism for providing pressure variations of the material by vibration of the actuating surface for controlling the breakup of the jet into drops;

wherein the method further comprises restricting a flow between the reservoir and the outflow opening by a restricted passage through a flow restricting structure comprising an inlet, in fluid connection with the reservoir, and an outlet, connected to a micro volume directly adjacent an inside of the nozzle; wherein the restricted passage is dimensioned relative to the outflow opening such that in use, a pressure drop of the material over the restricted passage between the inlet and outlet is between 0.1 and 10 times a pressure drop of the material over the outflow opening between the micro volume and an external surroundings of the nozzle; and guiding or reflecting pressure variations generated by the pressure regulating mechanism in the micro volume towards the outflow opening by the flow restricting structure and the nozzle.

* * * * *